US006593076B2

(12) United States Patent
Maeda et al.

(10) Patent No.: US 6,593,076 B2
(45) Date of Patent: Jul. 15, 2003

(54) PHOTOTHERMOGRAPHIC MATERIAL AND IMAGE FORMING METHOD

(75) Inventors: Keiko Maeda, Tokyo (JP); Tetsuo Shima, Tokyo (JP); Kazuyoshi Goan, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/837,608

(22) Filed: Apr. 18, 2001

(65) Prior Publication Data

US 2002/0042032 A1 Apr. 11, 2002

(30) Foreign Application Priority Data

Apr. 25, 2000 (JP) ..... 2000-124050
Aug. 21, 2000 (JP) ..... 2000-249697

(51) Int. Cl.[7] ..... G03C 1/498; G03C 1/00

(52) U.S. Cl. ..... 430/619; 430/523; 430/567; 430/604; 430/620; 430/630; 430/935

(58) Field of Search ..... 430/619, 523, 430/630, 620, 567, 935, 604

(56) References Cited

U.S. PATENT DOCUMENTS 4,193,804 A * 3/1980 Ikenoue et al. ..... 430/353
5,686,228 A * 11/1997 Murray et al. ..... 430/350
6,297,001 B1 * 10/2001 Takiguchi et al. ..... 430/619
6,368,782 B1 * 4/2002 Fukui et al. ..... 430/619

FOREIGN PATENT DOCUMENTS

EP 0803764 * 10/1997 ..... G03C/1/498

* cited by examiner

*Primary Examiner*—Thorl Chea
(74) *Attorney, Agent, or Firm*—Frishauf, Holtz, Goodman & Chick, P.C.

(57) ABSTRACT

A photothermographica material is disclosed, comprising an organic silver salt and a light sensitive silver halide, wherein the photothermographic material contains a hydrophilic binder of 0.5 to 2 g per mol of the organic silver salt and the organic silver salt having been formed in the presence of the silver halide of $7\times10^{15}$ to $3\times10^{17}$ grains per mol of the organic salt.

18 Claims, No Drawings

PHOTOTHERMOGRAPHIC MATERIAL AND IMAGE FORMING METHOD

FIELD OF THE INVENTION

The present invention related to photothermographic material, and an image recording method and image forming method by the use thereof.

BACKGROUND OF THE INVENTION

In the field of graphic arts and medical treatment, there have concerns in processing of photographic films with respect to effluents produced from wet-processing of image forming materials, and recently, reduction of the processing effluent is strongly demanded in terms of environmental protection and space saving. There has been desire a photothermographic material for photographic use, capable of forming distinct black images exhibiting high sharpness, enabling efficient exposure by means of a laser imager or a laser image setter.

Known as such a technique is a thermally developable photothermographic material which comprises on a support an organic silver salt, light sensitive silver halide grains, reducing agent and a binder, as described in U.S. Pat. Nos. 3,152,904 and 3,487,075, and D. H. Klosterboer "Thermally Processed Silver Systems" (Imaging Processes and Materials) Neblette, 8th Edition, edited by Sturge, V. Walworth, and A. Shepp, page 279, 1989), etc.

Such a photothermographic material is characterized in that light sensitive silver halide grains and an organic silver salt are incorporated in a light sensitive layer as a photosensor and a silver ion source, respectively, which are thermally developed by an included reducing agent at a temperature of 8– to 140° C. to form images, without being fixed. To achieve smoothly supplied silver ions to silver halide and prevent lowered transparency caused by light scattering, there have been made attempts to improve the shape of organic silver salt grains capable of being optimally arranged in the light sensitive layer and having little adverse effect on light scattering.

However, problems arose with attempts to form fine particles simply by dispersion or pulverization at high energy using a dispersing machine, due to the fact that silver halide grains or organic silver salt grains were damaged, resulting in not only increased fogging and reduced sensitivity but also deteriorated image quality. Accordingly, there have been desired techniques of achieving enhanced photosensitivity, higher density and reduced fogging without an increase of a silver coverage.

Further, problems arose with pre-exposure storage of photothermographic materials such that variation in sensitivity, fog density or contrast occurred and problems also arose with post-process storage that the fogging or image color tone was varied. There have been made various attempts but they are still insufficient, therefore, further enhanced improvement is desired.

SUMMARY OF THE INVENTION

It is an object of the present invention to provide a photothermographic material exhibiting enhanced sensitivity and reduced fogging, causing no deterioration in image quality due to a white spots or coagula and also improved in raw stock stability (i.e., pre-exposure stock keeping) and silver image lasting quality; and an image recording method and image forming method by the use of the same.

The above object of the invention can be accomplished by the following constitution:

1. A photothermographic material comprising an organic silver salt and a light sensitive silver halide, wherein the photothermographic material contains a hydrophilic binder of 0.5 to 2 g per mol of the organic silver salt and the organic silver salt being formed in the presence of the silver halide of $7\times10^{15}$ to $3\times10^{17}$ grains per mol of the organic silver salt;
2. A method of preparing a photothermographic material comprising the steps of:
   (a) preparing a light sensitive layer composition and
   (b) coating the light sensitive layer composition to form a light sensitive layer, wherein the photothermographic material comprises an organic silver salt, a light sensitive silver halide and a hydrophilic binder, step (a) comprising forming the organic silver salt in the presence of the silver halide of $7\times10^{15}$ to $3\times10^{17}$ grains per mol of the organic silver salt and the photothermographic material containing the hydrophilic binder of 0.5 to 2 g per mol of the organic silver salt.

DETAILED DESCRIPTION OF THE INVENTION

In this invention, the photothermographic material containing an organic silver salt, a light sensitive silver halide, a reducing agent, binder and a cross-linking agent, in which the photothermographic material contains a hydrophilic binder of 0.5 to 2.0 g per mol of the organic silver salt, and during the stage of formation of the organic silver salt, $7\times10^{15}$ to $3\times10^{17}$ grains of the light sensitive silver halide per mol of the organic silver salt are mixed to form the organic silver salt, thereby leading to a photothermographic material exhibiting enhanced sensitivity and reduced fogging, causing no deterioration in image quality due to a white spots or coagula and also improved in raw stock stability (i.e., pre-exposure stock keeping) and silver image lasting quality. In this invention, the light sensitive silver halide is preferably contained in amount of 0.8 to 2.0 g/m$^2$, based on silver.

It is contemplated that such effects of this invention are attributed to that adjustment of a hydrophilic binder surrounding the light sensitive silver halide grains to a specified quantity leads to efficient dispersion, thereby preventing coagulation of silver halide grains and efficient supply of silver ions from the organic silver salt at the stage of thermal development.

Silver halide used in the invention functions as light sensor. Silver halide grains are preferably small in size to prevent milky-whitening after image formation and obtain superior images. The grain size is preferably not more than 0.1 $\mu$m, more preferably, 0.01 to 0.1 $\mu$m, still more preferably, 0.03 to 0.07 $\mu$m, and most preferably 0.04 to 0.07 $\mu$m. The form of silver halide grains is not specifically limited, including cubic or octahedral, regular crystals and non-regular crystal grains in a spherical, bar-like or tabular form. Halide composition thereof is not specifically limited, including any one of silver chloride, silver chlorobromide, silver iodochlorobromide, silver bromide, silver iodobromide, and silver iodide.

In this invention, silver halide grains are used in an amount of $7\times10^{15}$ to $3\times10^{17}$ grains per mol of organic silver salt. The silver halide grains less than this range by number results in insufficient densities and the number exceeding this range leads to deteriorated image quality.

In this regard, the number of silver halide grains can be determined based on the density, specific gravity and size of the silver halide grains. The grain size can be determined by an electron microscope.

Silver halide used in this invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. Of these preferred are Fe, Co, Ru, Rh, Re, Os, and Ir. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3-or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different. Particularly preferred examples of M include rhodium (Rh), ruthenium (Ru), rhenium (Re), iridium (Ir) and osmium (Os).

Exemplary examples of transition metal ion complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[(RuBr_4(H_2O)]^{2-}$
9: $[Ru(NO)\ (H_2O)Cl_4]^{-}$
10: $[RhCl_5(H_2O)]^{2-}$
11: $[Re(NO)Cl_5]^{2-}$
12: $[Re(NO)(CN)_5]^{2}$
13: $[Re(NO)Cl(CN)_4]^{2-}$
14: $[Rh(NO)_2Cl_4]^{-}$
15: $[Rh(NO)\ (H_2O)Cl_4]^{-}$
16: $[Ru(NO)\ (CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)\ Cl_5]^{2-}$
21: $[Re(NO)C1_5]^{-}$
22: $[Os(NS)Cl_4(TeCN)]^{2-}$
23: $[Ru(NS)Cl_5]^{2-}$
24: $[Re(NS)\ Cl_4(SeCN)]_{2-}$
25: $[Os(NS)Cl(SCN)_4]^{2-}$
26: $[Ir(NO)\ Cl_5]^{2-}$
27: $[Ir(NS)\ Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, a growth, physical ripening, and chemical ripening. However, these are preferably added at the stage of nuclei formation, growth, and physical ripening; furthermore, are preferably added at the stage of nuclei formation and growth; and are more preferably added during the stage of growth of from ½ of the grain volume to the final grain (still more preferably during the stage of growth of from ¾ of the grain volume to the final grain). Herein, the expression "added during the stage of growth of from ½ of the grain volume to the final grain" means addition in the process of grain growth of from the site accounting for 50% of the grain volume to the grain surface.

These compounds may be added several times by dividing the addition amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a Unsuitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. For example, silver halide emulsions are prepared by mixing an aqueous silver salt solution with an aqueous halide solution in a protective colloidal solution as a reaction mother liquor perform nucleation and crystal growth, in which the silver salt and halide solutions are generally added by double jet addition. Specifically, the controlled double jet addition is representative, in which the solutions are mixed with controlling the pAg and pH. Various variations are included therein, such as a two-step process, in which after forming seed crystal grins (or nucleation), growth is successively performed under identical or different conditions (crystal growth or ripening). Thus, controlling various factors such as crystal habit or crystal sizes by regulating mixing condition in the process of mixing silver salt and halide solutions in an aqueous protective colloid solution is well known in the art. Subsequently to the mixing process, the desalting process is performed to remove soluble salts from the emulsion. As a known representative desalting process is a flocculation method, in which a coagulant is added to the prepared silver halide emulsion to cause silver halide grain to be flocculated and separated from the supernatant containing soluble salts. After decanting the supernatant, the coagulated gelatin containing silver halide grains is re-dispersed and then, flocculation and decantation are repeated to remove any remaining salts. There is also known a desalting method by ultrafiltration, in which unwanted low-molecular weight substances such as aqueous soluble salts can be removed using an ultrafiltration membrane such as a synthetic membrane which prevents permeation of macro-molecular weight substances such as silver halide grains and gelatin.

The hydrophilic binder may be contained in any layer of the photothermographic material and preferably at least in the layer containing the organic silver salt, in an amount of 0.5 to 2.0 g per mol of organic silver salt. The hydrophilic binder is a binder which is water-soluble or capable of being present in a colloidal form, and preferably is a binder capable of functioning as a protective colloid for silver halide grains in an aqueous solution. Hydrophilic binders usable in this invention include, for example, gelatin and water soluble polymers such as polyamide compounds and polyvinyl pyrrolidine compounds. Of these, gelatin is preferred.

There is needed 0.5 to 2.0 g of the hydrophilic binder per one mol of an organic silver salt to achieve the advantageous effects of this invention. In addition to being contained together with the silver halide grains, the hydrophilic binder may further be added at the stage of forming or dispersing the organic silver salt to adjust the content thereof. Insufficiency the hydrophilic binder results in incomplete dispersion of the organic silver salt and tendency for the salt to coagulate, leading to fogging, lowered covering power and deteriorated image quality caused by white spots or coagula. An excessive hydrophilic binder often inhibits adsorption of a dye or the like, resulting in insufficient sensitivity. The amount of the hydrophilic binder contained with light sensitive silver halide is Preferably not more than 40 g per mol of silver, and more preferably not more than 35 g per mol of silver. The binder content in a photothermographic material can be determined by methods currently known in the art. Specifically, the gelatin content can be determined in accordance with the procedure of hydrolysis with hydrochloric acid, concentration and dilution with a sodium citrate buffer solution, followed by amino acid analysis.

The thus formed photosensitive silver halide can be chemically sensitized with a sulfur containing compound, gold compound, platinum compound, palladium compound, silver compound, tin compound, chromium compound or their combination. The method and procedure for chemical sensitization are described in U.S. Pat. No. 4,036,650, British Patent 1,518,850, JP-A 51-22430, 51-78319 and 51-81124. As described in U.S. Pat. No. 3,980,482, a low molecular weight amide compound may be concurrently present to enhance sensitivity at the time of converting a part of the organic silver salt to photosensitive silver halide.

In this invention, it is preferred to conduct chemical sensitization with an organic sensitizer containing a chalcogen atom. The organic sensitizer containing a chalcogen atom preferably contains a group for promoting adsorption onto silver halide and a labile chalcogen atom.

Such organic sensitizers are those having various structures, as described in JP-A 60-150046, JP-A 4-109240 and 11-218874. Specifically, a compound represented by formula (S) is preferred, having a structure in which a chalcogen atom is attached a carbon atom or a phosphorus atom through a double bond:

formula (S)

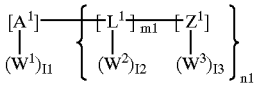

wherein $A^1$ represents an atomic group capable of being adsorbed onto silver halide; $L^1$ represents a bivalent linkage group; $Z^1$ represents an atomic group containing a labile chalcogen atom site; $W^1$, $W^2$ and $W^3$ each represent a carboxylic acid group, sulfonic acid group, sulfinic acid group, phosphoric acid group, phosphorus acid group or a boric acid group; m1 is 0 or 1; n1 is an integer of 1 to 3; 11, 12 and 13 each are an integer of 0 to 2, provided that 11, 12 and 13 may be 0 at the same time, i.e., an aqueous solubility-promoting group as defined above ($W^1$, $W^2$ and $W^3$) may not be contained.

Examples of the atomic group capable of being adsorbed onto silver halide, represented by $A^1$ include an atomic group containing a mercapto group (e.g., mercaptooxadiazole, mercapotetrazole, mercaptotriazole mercaptodiazole, mercaptothiazole, mercaptpthiadiazole, mercaptooxazole, mercaptoimidazole, mercaptobenzthiazole, mercaptobenzoxazole, mercaptobenzimidazole, mercaptotetrazaindene, mercaptopyridyl, mercaptoquinilyl, 2-mercaptopyridyl, mercaptophenyl, mercaptonaphthyl, etc.), an atomic group containing a thione group (e.g., thiazoline-2-thione, oxazoline-2-thione, imidazoline-2-thione, benzothiazoline-2-thione, benzimidazoline-2-thione, thiazolidine-2-thione, etc.), an atomic group capable of forming an imino-silver (e.g., triazole, tetrazole, benztriazole, hydroxyazaindene, benzimidazole, indazole, etc.), and an atomic group containing an ethenyl group {e.g., 2-[N-(2-propenyl)amino] benzthiazole, N-(2-propenyl)carbazole, etc.}.

The atomic group containing a labile chalcogen atom site represented by $Z^1$ refers to a compound group capable of forming a chalcogen silver in the presence of silver nitrate. The atomic group containing a labile chalcogen atom site preferably has a structure containing a chalcogen atom attached to a carbon atom or phosphorus atom through a double bond, in which the chalcogen atom refers to a sulfur atom, selenium atom or a tellurium atom. Examples of the atomic group containing a labile sulfur atom site include an atomic group containing a thiourea group (e.g., N,N'-diethylthiourea, N-ethyl-N'-(2-thiazolyl)thiourea, N,N'-dimethylthiourea, N-phenylthiourea, etc.), an atomic group containing a thioamido group (e.g., thiobenzamide, thioacetoamide, etc.), polysufide, an atomic group containing a phosphine sulfide group [e.g., bis (pentafluorophenyl) phenylphosphine sulfide, diethylphosphine sulfide, dimethylphenylphosphine sulfide, etc.], and an atomic group containing a thiooxoazolidinone group (e.g., ethylrhodanine, 5-benzylidene-3-ethylrhodanine, 1,3-diphenyl-2-thiohydantoine, 3-ethyl-4-oxooxazolidine-2-thione, etc.). Examples of the atomic group containing a labile selenium atom site include an atomic group containing a selenourea group (e.g., N,N'-dimethylselenourea, selenourea, N-acetyl-N,N'-diethylselenourea, N-trifluoroacetyl-N',N'-dimethylselenourea, N-ethyl-N'-(2-thiazolyl)selenourea, N,N'-diphenylselenourea, etc.), an atomic group containing a selenoamido group (e.g., N-methyl-selenobenzamide, N-phenyl-selenobenzamide, N-ethyl-selenobenzamide, etc.), an atomic group containing a phosphine selenide [e.g., triphenyl-phosphine selenide, diphenyl(entafluorophenyl) phosphine selenide, tris(m-chlorophenyl)phosphine selenide, etc.], an atomic group containing selenophosphate group [e.g., tris(p-tolyl)selenophosphate, etc.], an atomic group containing a selenoester group (e.g., p-methoxyselenobenzoic acid═O-isopropylester, selenobenzoic acid=Se-(3'-oxobutyl)ester, p-methoxyselenobenzoic acid═Se-(3' oxocyclohexyl)ester, etc.), an atomic group containing a selenide group [e.g., bis(2,6-dimethoxybenzoyl)selenide, bis(n-butoxycarbonyl) selenide, bis(benzyloxycarbonyl)selenide, bis(N,N-dimethylcarbamoyl)selenide, etc.], an atomic group containing triselenane group [e.g., 2,4,6-ris(p-methoxyphenyl) triselenane, etc.], and an atomic group containing aselenoketone group (e.g., 4-methoxyselenoacetophenone, 4,4-methoxyselenobenzophenone, etc.). Examples of the atomic group containing a labile tellurium atom site include an atomic group containing a phosphine telluride group (e.g., butyl-di-isopropylphosphine telluride, triscyclohexylphosphine telluride, etc.), an atomic group containing a tellurourea group (e.g., N,N'-diethyl-N,N'-diethylenetelluorourea, N,N'-dimethylene-N,N'-dimethyltellyrourea, etc.), an atomic group containing a telluoroamido group [e.g., N,N-dimethyl-tellurobenzamide, N,N-tetramethylene-(p-tolyl)tellurobenzamide], an atomic group containing a tellurophosphate group [e.g., tris(p-tolyl) tellurophosphate, trisbutyltellurophosphate, etc.], and an atomic group containing a telluophosphoric amido group (e.g., hexamethyltellurophosphoric amide, etc.).

The atomic group containing a labile selenium or tellurium atom can also be selected from the compounds described in JP-A Nos. 4-25832, 4-109240, 4-147250, 4-33043, 5-40324, 5-24332, 5-24333, 5-303157, 5-306268, 5-306269, 6-27573, 6-43576, 6-75328, 6-17528, 6-180478, 6-17529, 6-208184, 6-208186, 6-317867, 7-92599, 7-98483, 7-104415, 7-140579, and 7-301880.

The chalcogen atom-containing organic sensitizers used in this invention may contain an aqueous solubility-promoting group. Examples of the aqueous solubility-promoting group include a carboxylic acid group, sulfonic acid group, sulfinic acid group, phosphoric acid group, phosphorus acid group or a boric acid group. The chalcogen atom-containing organic sensitizers used in this invention may contain a group capable of being adsorbed onto silver halide and a labile chalcogen atom site. The group capable of being adsorbed onto silver halide and the labile chalcogen atom site may be linked directly or through a linkage group with each other. In cases where an aqueous solubility-promoting group is further contained, the aqueous solubility-promoting group, the group capable of being adsorbed onto silver halide and the labile chalcogen atom site may be linked directly or through a linkage group with each other.

The bivalent linkage group represented by $L^1$ is a group comprising a carbon atom, hydrogen atom, oxygen atom, nitrogen atom or sulfur atom. Examples thereof an alkylene group having 1 to 20 carbon atoms (e.g., methylene, ethylene, propylene, hexylene, etc.), an arylenes group (e.g., phenylene, naphthylene, etc.), —$CONR_1$—, —$SO_2NR_2$—, —O—, —S—, —$NR_3$—, —$NR_4CO$—, —$NR_5SO_2$—, —$NR_6CONR_7$—, —CO—O—, —O——CO—, —CO— and groups in which plural these groups are linked.

$R_1$, $R_2$, $R_3$, $R_4$, $R_5$, $R_6$, and $R_7$ are each a hydrogen atom, an aliphatic group, an alicyclic group, an aromatic group or a heterocyclic group. The aliphatic group represented by $R_1$, through $R_7$ include, for example, a straight chaine or branched alkyl group having 1 to 20 carbon atoms (e.g., methyl, ethyl, isopropyl, 2-ethyl-hexyl, etc.), an akenyl group (e.g., propenyl, 3-pentenyl, 2-butenyl, cyclohexenyl, etc.), an alkynyl group (e.g., propargyl, 3-pentynyl, etc.) and an aralkyl group (e.g., benzyl, phenethyl, etc.). The alicyclic group is one having 5 to 8 carbon atoms (e.g., cyclopentyl, cyclohexyl, etc.); the aromatic group is a monocyclic or condensed ring group having 6 to 10 carbon atoms, such as phenyl or naphthyl; and the heterocyclic group an oxygen, sulfur or nitrogen containing, 5-to 7-membered monocyclic ring or ring condensed with other ring)s), such as furyl, thienyl, benzfuryl, pyrrolyl, indolyl, thiazolyl, imidazolyl, mprpholyl, piperazyl, or pyrazyl. The groups represented by $R_1$ through $R_7$ may be substituted with an optimal atom or group at the optimal position. Examples of the substituent atom or group include hydroxy, a halogen atom (e.g., fluorine, chlorine, bromine, iodine), cyano, amino group (e.g., metylamino, anilino, diethylamino, 2-hydroxyethylamino, etc.), acyl group (e.g., acetyl, benzoyl, propanoyl, etc.), carbamoyl group (e.g., carbamoyl, N-methylcarbamoyl, N,N-tetramethylenecarbamoyl, N-methanesulfonylcarbamoyl, N-acetylcarbamoyl, etc.), alkoxy group (e.g., methoxy, ethoxy, 20hydroxyethoxy, 2-methoxyethoxy, etc.), alkoxycarbonyl group (e.g., methoxycarbonyl, ethoxycarbonyl, 2-methoxyethoxycarbonyl, etc.), sulfonyl group (e.g., methanesulfonyl, trifluoromethanesulfonyl, benzenesulfonyl, p-toluenesulfonyl, etc.), sulfamoyl group (e.g., sulfamoyl, N,N-dimethyl-sulfamoyl, morpholinosulfamoyl, N-ethylsulfamoyl, etc.), acylamino group (e.g., acetoamide, trifluoroacetoamido, benzamido, thienocarbonylamino benzenesulfonamido, etc.), and alkoxycarbonylamino, (e.g., methoxycarbonylamino, N-methyl-ethoxycarbonylamino etc.).

$W^1$, $W^2$ and $W^3$ each a carboxylic acid group, sulfonic acid group, sulfinic acid group, phosphoric acid group, phosphorus acid group or a boric acid group, each of which may be in a free form or may be a counter salt with an alkali metal, alkaline earth metal, ammonium or an organic amine.

Exemplary examples of the chalcogen atom-containing organic sensitizers usable in this invention and the compound represented by formula (S) own below but by no means limited to these

S-1

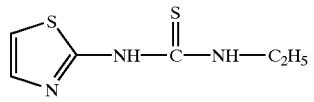

S-2

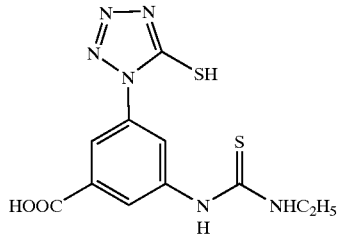

-continued
S-3
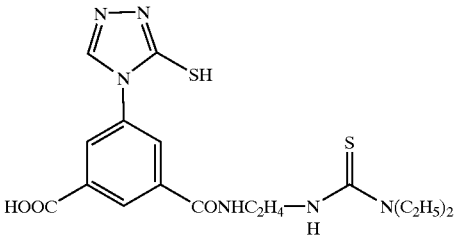
S-4
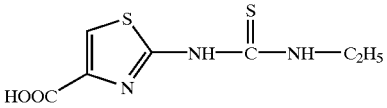
S-5
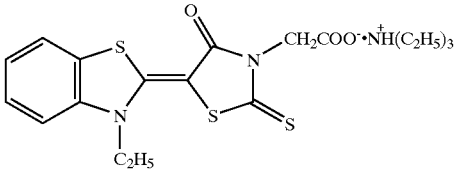
S-6
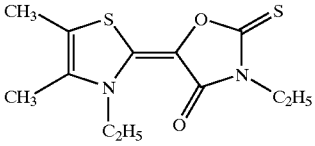
S-7
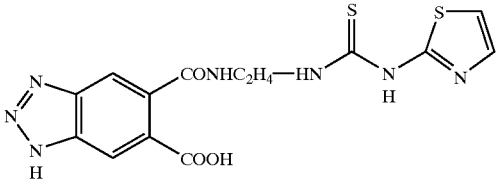
S-8
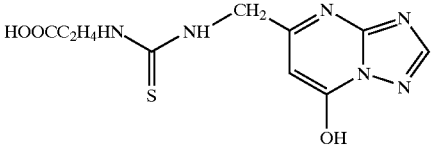
S-9
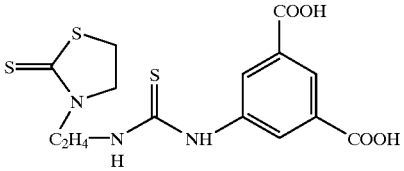
S-10
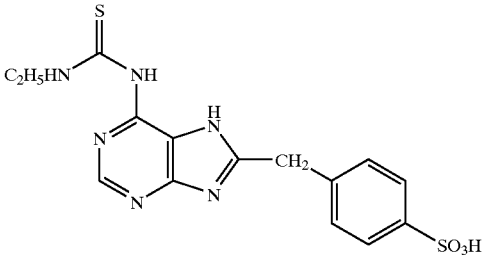
-continued
S-11
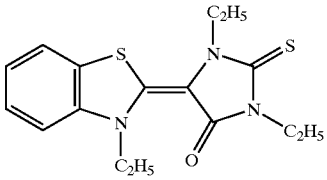
S-12
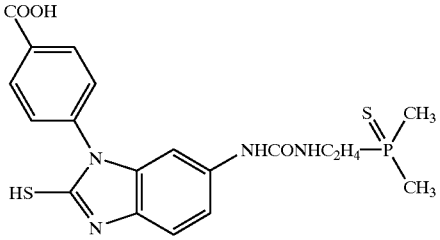
S-13
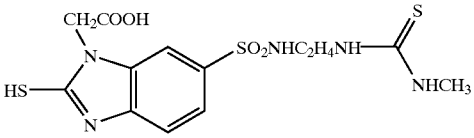
4
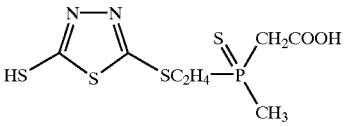
S-15
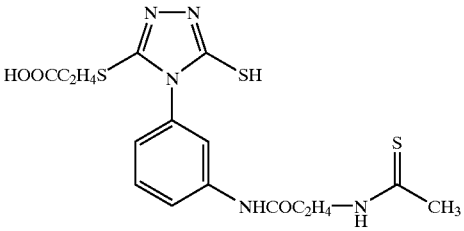
S-16
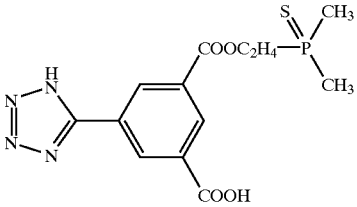
S-17
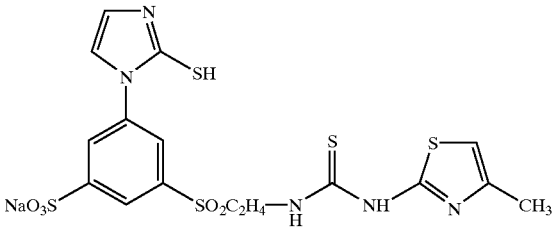
S-18
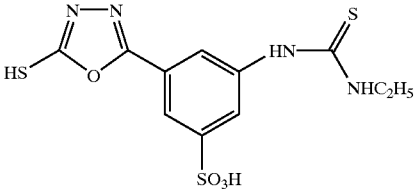

-continued
S-19
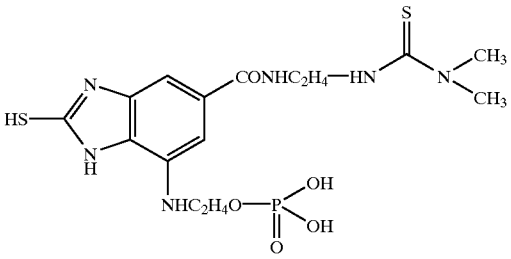
S-20
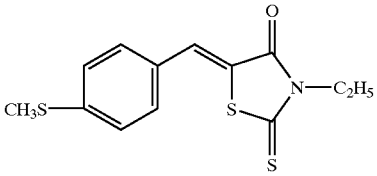
S-21
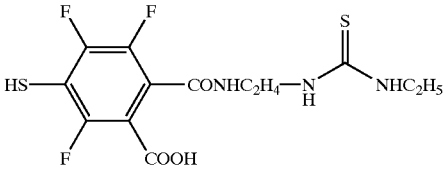
S-22
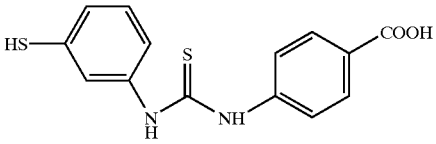
S-23
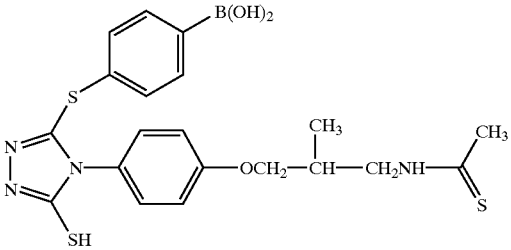
S-24
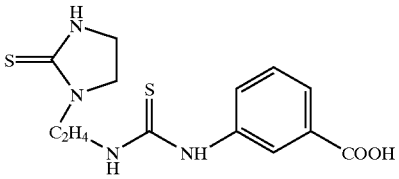
S-25
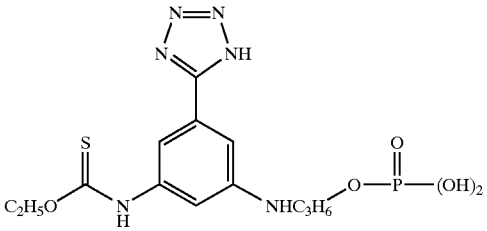
-continued
S-26
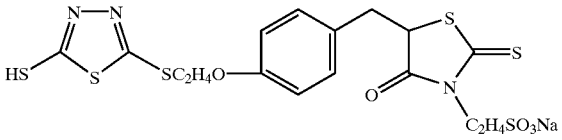
S-27
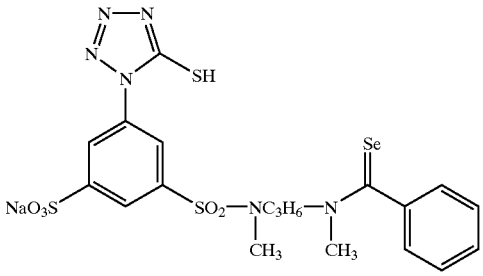
S-28
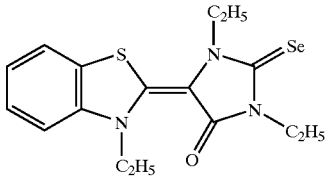
S-29
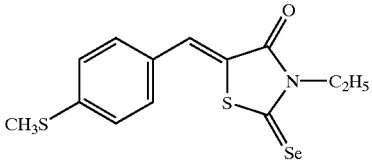
S-30
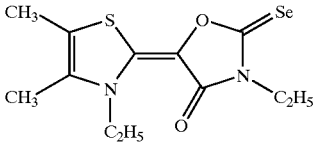
S-31
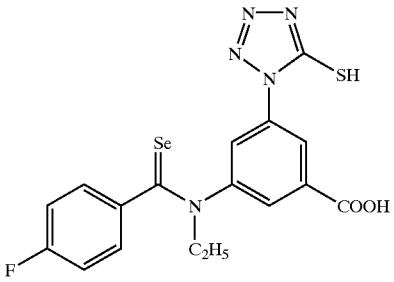
S-32
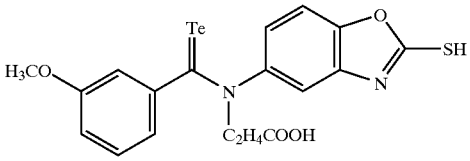
S-33
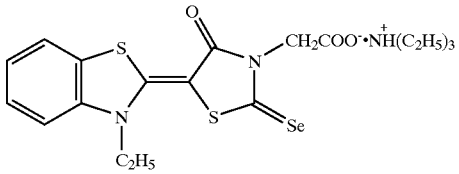

-continued
S-34
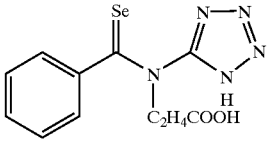
S-35
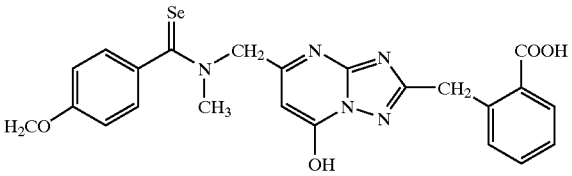
S-36
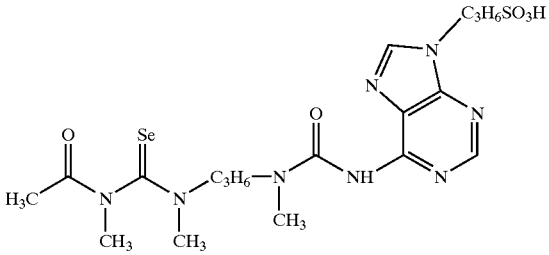
S-37
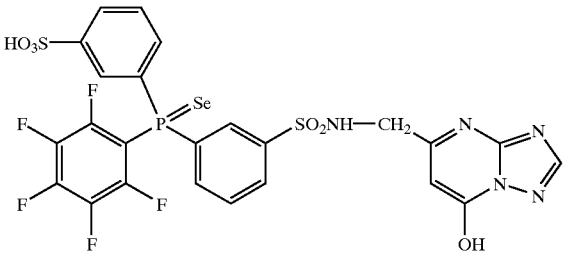
S-38
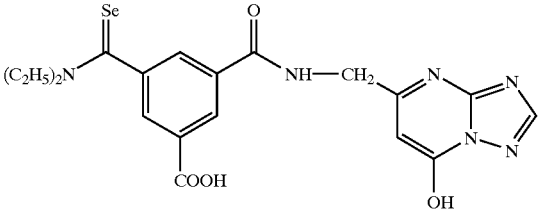
S-39
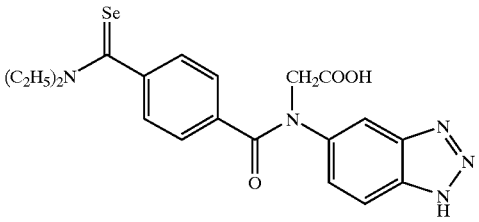
-continued
S-40
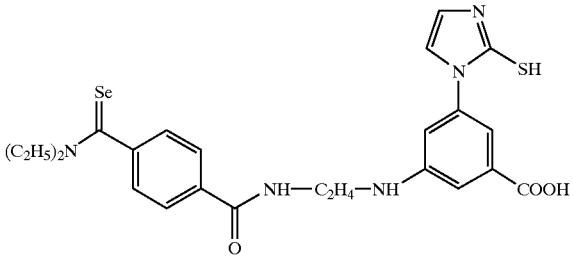
S-41
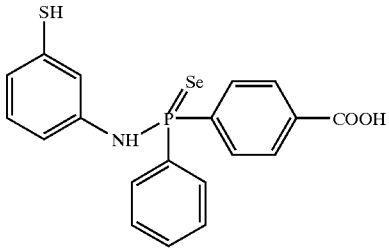
S-42
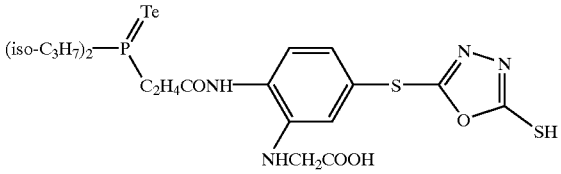
S-43
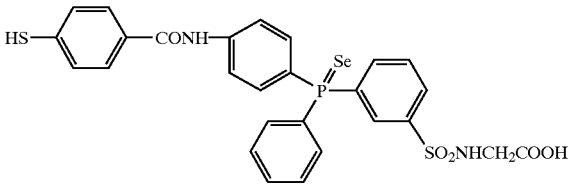
S-44
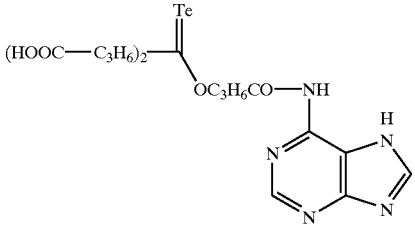
S-45
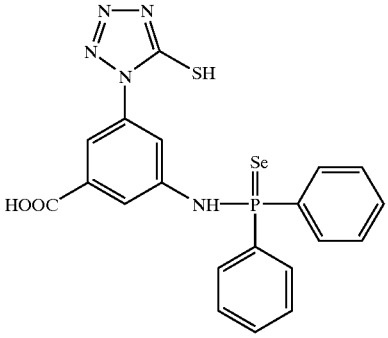

-continued
S-46
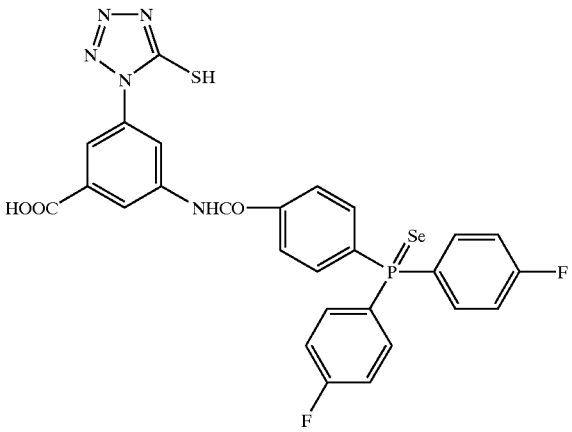
S-47
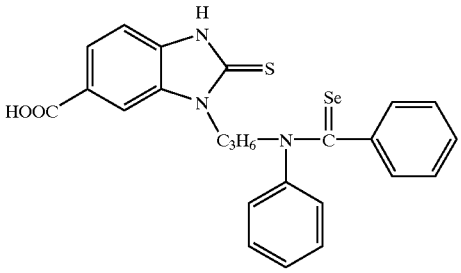
S-48
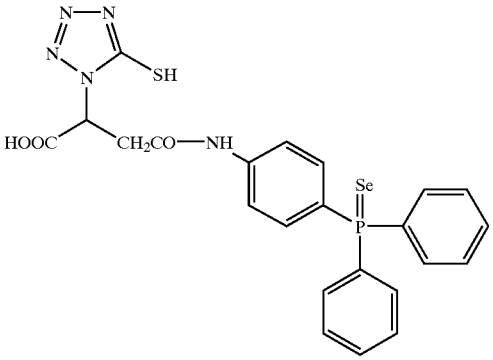
S-49
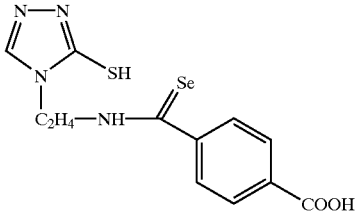
S-50
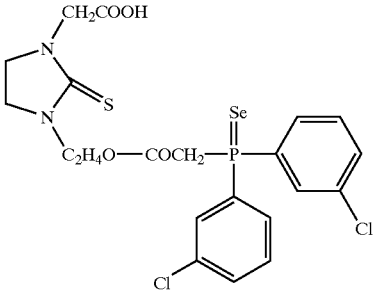
-continued
S-51
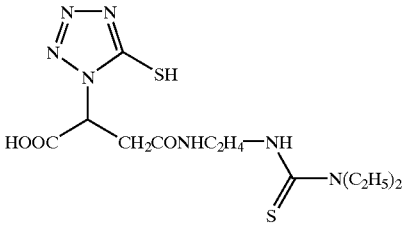
S-52
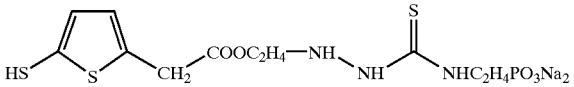
S-53
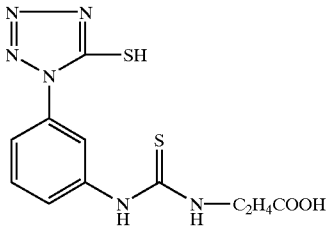
S-54
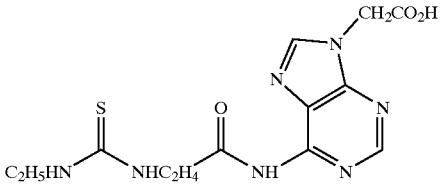
S-55
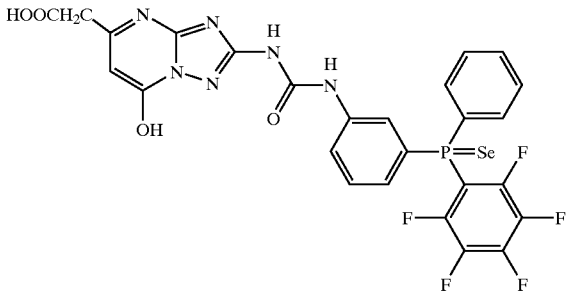
S-56
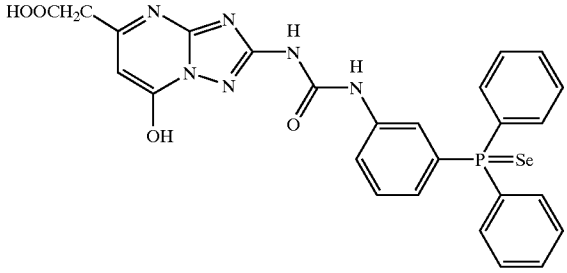

-continued
S-57
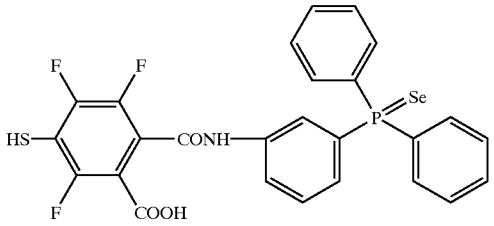
8
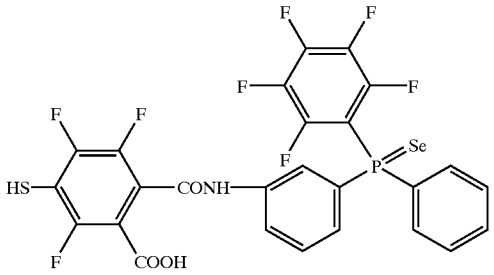
S-59
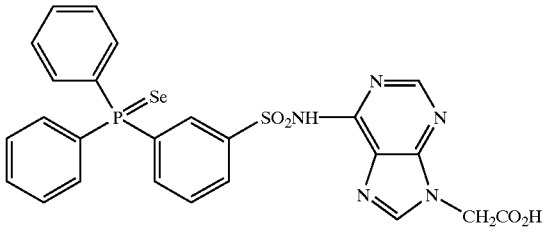
S-60
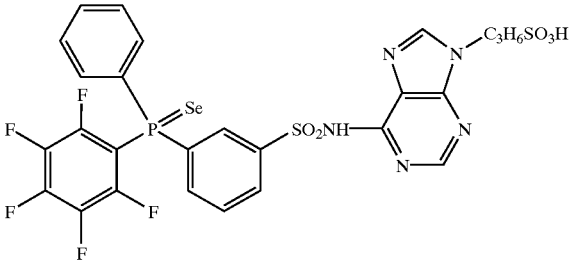
S-61
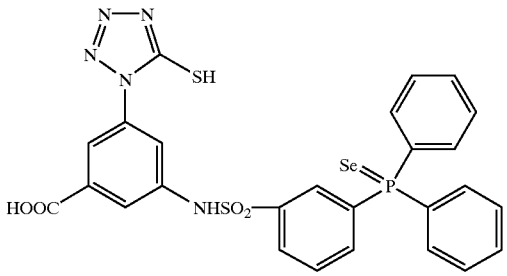
-continued
S-62
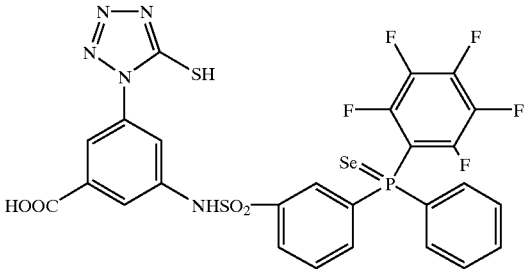
S-63
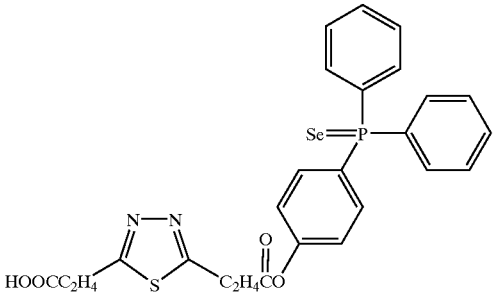
S-64
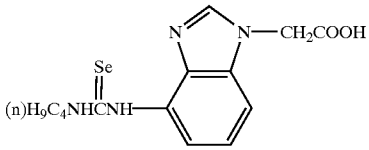
S-65
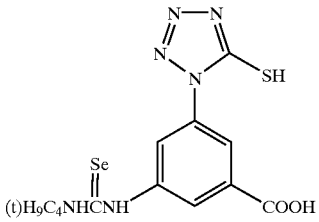
S-66
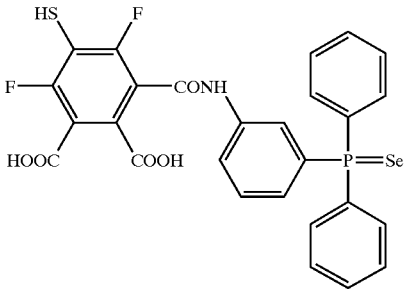
S-67
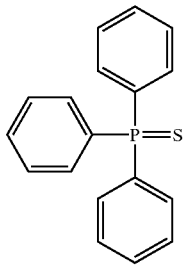

The amount of the chalcogen atom-containing organic sensitizers to be used in this invention, depending on the kind of a chalcogen compound, light sensitive silver halide grains and the chemical sensitization environment is preferably $10^{-8}$ to $10^{-2}$ mol. and more preferably $10^{-7}$ to $10^{-3}$ mol per mol of silver halide. In this invention, the chemical sensitization environment is not specifically limited and it is preferred to conduct chemical sensitization with the chalcogen atom-containing organic sensitizer, in the presence of a compound capable of allowing silver chalcogenide or silver nuclei formed on the light sensitive silver halide grains to disappear or to be reduced in size, specifically in the presence of an oxidizing agent capable of oxidizing the silver nuclei. The preferred sensitizing condition thereof includes a pAg of 6 to 11, and more preferably 7 to 10, a pH of 5 to 8, and a temperature of 30° C. or less. The excessively high temperature accelerates side reaction, leading to increased fogging and lowering stability of the photothermographic material. In the photothermographic material of this invention, it is therefore preferable that the light sensitive silver halide grains are chemically sensitized at a temperature of 30° C. or less, using the chalcogen atom-containing organic sensitizer in the presence of silver nuclei formed on the grains. It is also preferred that the resulting silver halide grains are mixed with an organic silver salt, dispersed and dried.

It is also preferred to conduct chemical sensitization with the organic sensitizer in the presence of a sensitizing dye or a heteroatom-containing compound capable of being adsorbed onto silver halide. Performing chemical sensitization in the presence of the compound capable of being adsorbed onto silver halide prevents dispersion of chemical sensitization center nuclei, leading to enhanced sensitivity and minimized fogging. The preferred heteroatom containing compound capable of being adsorbed onto silver halide include nitrogen containing heterocyclic compound described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1, 2, 4-thiadiazole ring, 1,2,5-thiadiazole ring, 1,2,3, 4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. Examples thereof are shown below but are not limited to these:

(1) 2,4-dihydroxy-6-methyl-1,3a,7-triazaindene,
(2) 2,5-dimethyl-7-hydroxy-1,4,7a-triazaindene,
(3) 5-amino-7-hydroxy-2-methyl-1,4,7a-triazaindene,
(4) 4-hydroxy-6-methyl-1,3,3a,7-tetrazaindene.
(5) 4-hydroxy-1,3,3a,7-tetrazaindene,
(6) 4-hydroxy-6-phenyl-1,3,3a,7-tetrazaindene,
(7) 4-methyl-6-hydroxy-1,3,3a,7-tetrazaindene,
(8) 2,6-dimethyl-4-hydroxy-1,3,3a,7-tetrazaindene,
(9) 4-hydroxy-5-ethyl-6-methyl-1,3,3a,7-tetrazaindene,
(10) 2,6-dimethyl-4-hydroxy-5-ethyll,3,3a,7 tetrazaindene,
(11) 4-hydroxy-5,6-dimethyl-1,3,3a,7-tetrazaindene,
(12) 2,5,6-trimethyl-4-hydroxy-1,3,3a,7-tetrazaindene,
(13) 2-methyl-4-hydroxy-6-phenyl-1,3,3a,7-tetrazaindene,
(14) 4-hydroxy-6-methyl-1,2,3a,7-tetrazaindene,
(15) 4-hydroxy-6-ethyl-1,2,3a,7-tetrazaindene,
(16) 4-hydroxy-6-phenyl-1,2,3a,7-tetrazaindene,
(17) 4-hydroxy-1,2,3a,7-tetrazaindene,
(18) 4-methyl-6-hydroxy-1,2,3a,7-tetrazaindene,
(19) 7-hydroxy-5-methyl-1,2,3,4,6-pentazaindene
(20) 5-hydroxy-7-methyl-1m2,3,4,6-pentazaindene,
(21) 5,7-dihysroxy-1,2,3,4,6-pentazaindene,
(22) 7-hydroxy-5-methyl-2-phenyl-1,2,3,4,6-pentazaindene,
(23) 5-dimethylamino-7-hydroxy-2-phenyl-1,2,3,4,6-pentazaindene.

The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

Silver halide to be subjected to chemical sensitization may be one in the presence or in the absence of organic silver salts, or may be mixture thereof.

In one preferred embodiment of this invention, the overall process of forming light sensitive silver halide is performed at a pH of 3 to 6, more preferably 4 to 6.

The determination of transition metals occluded in the light sensitive silver halide used in this invention will be described. Distribution of the concentration of a transition metal within a silver halide grain can be determined by stepwise dissolution of the grain from the grain surface and determination of the transition metal content at each site, for example, according to the following procedure.

Prior to the determination of the transition metal, a silver halide emulsion was subjected to the following pretreatment. To ca 30 ml of the emulsion, 50 ml of an aqueous 0.2% actinase solution was added and stirred at 40° C. for 30 min. to perform hydrolysis of gelatin. Such procedure was repeated five times. After centrifugal separation, the r hydrolysis products were washed five times with 50 ml methanol, twice with a 1 mol/l nitric acid solution and five times with ultra-pure water, and after centrifugal separation, only the silver halide was separated. Surface portions of the thus obtained silver halide grains were dissolved with an aqueous ammonia solution or a pH-adjusted ammonia solution (in which the ammonia concentration or pH was varied in accordance with the halide composition of silver halide and the dissolution amount). Specifically, as a method for dissolving the outermost surface of silver halide grains, 2 g of the silver bromide grains can be washed to a depth of about 3% from the surface, using 20 ml of an aqueous ca. 10% ammonia solution. As a result, the amount of dissolved silver halide can be determined in such a manner that after separation of silver halide grains from the aqueous ammonia solution used for dissolving silver halide by centrifugation, the silver content of the supernatant can be determined using an inductively coupled plasma-mass spectroscopy (ICP-MS), or inductively coupled plasma-atomic emission spectroscopy (ICP-AES) or atomic absorption spectroscopy. Thus, the amount of the transition metal contained to a depth of 3% from the surface can be determined from the difference in the total metal content of silver halide grains between before and after being subjected to surface dissolution. The transition metal content can be determined by dissolution with an aqueous ammonium thiosulfate solution, aqueous sodium thiosulfate solution or aqueous potassium cyanide solution, followed by the matrix-matched ICP-MS method, ICP-AES method or atomic absorption analysis method. In the case of employing potassium cyanide as a solvent and the ICP-MS as an analysis apparatus (FISON, available from Elemental Analysis Corp.), for example, after dissolving ca. 40 mg of silver halide in 5 ml of an aqueous 0.2 mol/1 potassium cyanide solution, a solution of Cs as an internal standard element was added to form a content of 10 ppb and ultra-pure water was further added to make 100 ml to prepare a sample. Using a calibration curve matrix-fitted by using silver halide free of the transition metal, the transition metal content of the sample was determined by the ICP-MS method. In this case, the silver content of the sample can be precisely determined by subjecting the sample diluted with ultra-pure water to a factor of 100 to the ICP-AES or atomic absorption analysis. Further, the transition metal content in the interior of the silver halide grain can also be determined in the manner that after subjecting the grain surface to dissolution, the silver halide grains are washed with ultra-pure water and then the grain surface dissolution is repeated.

A transition metal doped in the peripheral region of the silver halide grain can also be determined by the foregoing method of determining the transition metal content, in combination with electron microscopic observation. In cases where plural transition metals are contained, the total content thereof are counted by mol. number.

In the embodiments of this invention, it is preferred that when the photothermographic material is subjected to light exposure of 280 $\mu J/cm^2$ and thermal development at 123° C. for 16.5 sec., not more than 25% by number (and more preferably not more than 20% by number) of the light sensitive silver halide grains having a grain diameter of 10 to 100 nm is not in contact with developed silver, thereby leading to enhanced sensitivity, low$\bar{x}$r fogging and improved latent image stability after exposure and before thermal development.

Thermal development at 123° C. for 16.5 sec. can be conducted by bringing the photothermographic material into contact with a thermal-developing drum heated at 123° C. for a period of 16.5 sec.

The percentage by number of the light sensitive silver halide grains which are not in contact with developed silver can be determined in accordance with the following procedure. Thus, a thermally developed light sensitive layer coated on the support is adhered to an optimum holder, using an adhesive. Using a diamond knife, an ultra-thinned slice having a thickness of 0.1 to 0.2 $\mu$m in the direction vertical to the support is prepared. The thus prepared ultra-thin slice is placed on a carbon membrane supported by a copper mesh, having been subjected to glow discharge treatment to enhance hydrophilicity and observed with a transmission electron microscope (also denoted as TEM) at a magnifying factor of 5,000 to 40,000, while cooled with liquid nitrogen to a temperature lower than −130° C. The electron microscopic image is recorded by means of a photographic film, an imaging plate or a CCD camera. An optimal portion not having been broken or loose is selected. In this invention, when the distance between an organic silver salt and a silver halide grain is not more than 2 mm in the electron micrograph obtained at a magnification of 40,000, it is regarded as being in contact, and when the distance is more than 2 mm, it is regarded as not being in contact.

A carbon membrane supported by an organic membrane such as collodion or form bar is preferably used and a single carbon membrane which is obtained by forming it on a rocksalt substrate and removing the substrate by dissolution or obtained by removing the organic membrane by dissolution with an organic solvent or by ion-etching is more preferably used.

The acceleration voltage of the TEM is preferably 80 to 400 kV, and more preferably 80 to 200 kV.

The number of light sensitive silver halide grains being present within a given area, A ($\mu m^2$) of the recorded image is counted according to the following equation:

grain number per 1 $\mu m^3$=number of silver halide grains being present within a given area (A) of the recorded image/area A x slice thickness ($\mu$m).

In this case, the number of the field of view is determined so as to amount to 1000 or more silver halide grains. The slice thickness can be determined in such a manner that photographed slice was warmed to room temperature, buried in epoxy resin and the section thereof was observed.

Next, a film which has been subjected to exposure of 280 $\mu J/cm^2$ and thermal development at 123° C. for 16.5 sec. is also similarly treated. Thus, the prepared a slice is observed with the TEM to count the number of silver halide grains which are not in contact with developed silver to determine the number of remaining silver halide grains. In this case, the number of the field of view is determined so as to amount to 1000 or more silver halide grains:

percent by number of silver halide grains which are not in contact with developed silver=(number of silver halide grains which are not in contact with developed silver, per 1 $\mu m^3$)/(number of silver halide grains/$\mu m^3$ in a raw film)×100.

Details of techniques for electron microscopic observation and techniques for preparing samples are referred to "Medical and Biological Electron Microscopic Observation" edited by NIHON DENSHIKENBIKYO GAKKAI, KANTO-SHIBU, published by MARUZEN and "Preparation of Biological Samples for Electron Microscopic Observation" edited by NIHON DENSHIKENBIKYO GAKKAI, KANTO-SHIBU, published by MARUZEN.

Organic silver salts used in this invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

In the present invention, organic silver salts have an average grain diameter of 2 $\mu$m or less and are monodisperse. The grain diameter of the organic silver salt as described herein is, when the organic salt grain is, for example, a spherical, cylindrical, or tabular grain, a diameter of the sphere having the same volume as each of these grains. The average grain diameter is preferably between 0.05 and 1.5 $\mu$m, and more preferably between 0.05 and 1.0 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

AR=diameter ($\mu$m)/thickness ($\mu$m)

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g/m$^2$, leading to high contrast images. In this case, the amount is represented in terms of equivalent converted to silver. The amount of silver halide is preferably 50% by weight or less, more preferably 25% by weight or less, and still more preferably 0.1 to 15% by weight, based on the total silver amount.

Dispersion of organic silver salts used in this invention will be described. Optionally after preliminarily dispersed together with a binder or a surfactant, organic silver salt grains are preferably pulverized and dispersed by means of a media dispersing machine or a high pressure homogenizer. In the preliminary dispersion, conventional anchor-type or propeller-type stirring machine, a high-speed centrifugal radiation type stirring machine (or dissolver) or a high-speed rotational shearing type stirrer (homomixer) are employed. Examples of the media dispersing machine include a convolution mill such as a ball mill, planet ball mill or vibration ball mill, a medium-stirring mill such as beads mill or atreiter, and a basket mill. The high pressure homogenizer include a type of colliding with wall or plug, a type in which plural divided liquids are allowed to collide with each other and a type of passing through fine orifice.

Preferred examples of ceramics used for ceramic beads used in media dispersion include $Al_2O_3$, $BaTiO_3$, $SrTiO_3$, MgO, Zro, BeO, $Cr_2O_3$, $SiO_2$, $SiO_2$—$Al_2O_3$, $Cr_2O_3$—MgO, MgO—CaO, MgO—$Al_2O_3$ (spinel), SiC, $TiO_3$, $K_2O$, $Na_2O$, BaO, PbO, $PbO_3$, $SrTiO_3$ (strontium titanate), $BeAl_2O_4$, $Y_3Al_5O_{12}$, $ZrO_2$—$Y_2O_3$ (cubic zirconia), 3BeO—$Al_2O_3$-$6SiO_2$ (synthetic emerald), C (synthetic diamond), $Si_2O$-$nH_2O$, silicon nitride, yttrium-stabilized zirconia, zirconia-reinforced alumina. Of these, yttrium-stabilized zirconia and zirconia-reinforced alumina (hereinafter, such zirconia-containing ceramics are also called zirconia) are specifically preferred in terms of having less formation of impurities produced by friction with beads or the dispersing machine at the time of dispersion.

In apparatuses used for dispersing tabular organic silver salt grains, ceramics such as zirconia, alumina, silicon nitride and boron nitride, or diamond are preferably employed as material for the member in contact with the organic silver salt grains. Zirconia is specifically preferred.

When the foregoing dispersion is conducted, 0.1 to 10% by weight of a binder, based on organic silver salt is preferably used and the temperature is preferably maintained at not more than 45° C. during the preliminary dispersion and the main dispersion. In the main dispersion, the high pressure homogenizer is operated twice or more at 29.42 MPa to 98.06 MPa, and in the case of employing the media dispersing machine, it is preferably operated at a circumferential speed of 6 to 13 m/sec.

Zirconia can be employed as beads or a part of a member, which may be mixed with the emulsion at the time of dispersing. Thereby, enhanced photographic performance can be achieved. Zirconia fragments may be added at the time of dispersion or preliminary dispersion. Methods therefore are not specifically limited and, for example, highly concentrated zirconia solution can be obtained by allowing methyl ethyl ketone (MEK) to circulate in a beads mill filled with zirconia beads.

In this invention, it is preferred to disperse the organic silver salt together with light sensitive silver halide in a water-miscible solvent. The water-miscible solvent refers to an organic solvent exhibiting a solubility in water of 3% by weight or more. Examples thereof include acetone, methyl ethyl ketone, methyl isobutyl ketone, methanol, ethanol, isopropanol, butanol, tetrahydrofurane, dioxane, dioxirane, dimethylformamide, dimethylacetoamide, and N-methylpyrrolidone. Of these, methyl ethyl ketone is preferred.

Commonly known reducing agents are used in the photothermographic materials, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazolines, phenylenediamines, hydroxyamines, hydroquinone monoethers, hydrooxamic acids, hydrazides, amidooximes, and N-hydroxyureas. Further, exemplary examples thereof are described in U.S. Pat. Nos. 3,615,533, 3,679,426, 3,672,904, 3,51,252, 3,782,949, 3,801,321, 3,794,488, 3,893,863, 3,887,376, 3,770,448, 3,819,382, 3,773,512, 3,839,048, 3,887,378, 4,009,039, and 4,021,240; British Patent 1,486,148; Belgian Patent 786,086; JP-A 50-36143, 50-36110, 50-116023, 50-99719, 50-140113, 51-51933, 51-23721, 52-84727; and JP-B 51-35851. An optimal reducing agent can be selected from these reducing agents.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis (2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis (4-hydroxy-3,5-di-t-butylphenyl)propane, as described in U.S. Pat. No. 3,589,903 and 4,021,249, British Patent 1,486,148, JP-A 51-51933, 50-36110 and 52-84727 and JP-B 51-35727; bisnaphthols described in U.S. Pat. No. 3,672,904, such as 2,2'dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-l-2 naphthyl)methane, 4,41-dimethoxy-l,1'-dihydroxy-2,2'-binaphthyl; sulfonamidophenols or sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The photothermographic material preferably contains, in addition to the foregoing components, an additive, which is called an image toning agent, color tone providing agent or activator toner (hereinafter, called an image toning agent). The image toning agent concerns oxidation-reduction reaction of an organic silver salt with a reducing agent, having a function of increasing color of the formed silver image or making it black. Image toning agents are preferably incorporated into the photothermographic material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides [for example, N-(dimethylaminomethyl)phthalimide]; blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-l-methylethylidene-2-thio-2,4-oxazolidinedione); phthalazinone, phthalazinone derivatives or metal salts thereof (for example, 4-(l-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-iones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a,5,6a-tatraazapentalene) Preferred image color control agents include phthalazone or phthalazine.

Binders other than the binder used in the formation of organic silver salts. Binders used in the image forming layer are transparent or translucent and generally colorless, including natural polymers, synthetic polymers or copolymers and film forming mediums. Exemplary examples thereof include gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic. Of these binders, water insoluble polymers are preferred such as cellulose acetate, cellulose acetate-butyrate and polyvinyl butyral, and polyvinyl butyral is more preferred.

Ad The binder content in the light sensitive layer is preferably 1.5 to 6 g/m$^2$, and more preferably 1.7 to 5 g/m$^2$. The content of less than 1.5 g/m$^2$ often results in an increase in density of the unexposed area to levels unacceptable in practical use.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side.

In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the light sensitive layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination.

Sensitizing dyes are applicable to the light-sensitive layer of photothermographic materials used in this invention, including those which are described in JP-A 63-159841, 60-140335, 63-231437, 63-259651, 63-304242, 63-15245; U.S. Pat. Nos. 4,639,414, 4,740,455, 4,741,966, 4,751,175 and 4,835,096. Further, sensitizing dyes usable in this invention are described in Research Disclosure item 17643, IV-A, page 23 (December, 1978) and references cited therein. Sensitizing dyes exhibiting spectral sensitivity specifically suitable for spectral characteristics of various scanner light sources can be advantageously selected. There can be selected, for example, simple merocyanines described in JP-A No. 60-162247 and 2-48635, U.S. Pat. No. 2,161,331, German Patent No. 936,071, and Japanese Patent Application No. 3-189532, which are suitable for an argon ion laser light source; three-nuclei cyanine dyes described in JP-A No. 50-62425, 54-18726, 59-102229 and merocyanine dyes described in Japanese Patent Application No. 6-103272, which are suitable for a helium-neon laser light source; thiacarbocyanine dyes described in JP-B No. 48-42172, 51-9609, 55-39818 (hereinafter, the term, JP-B refers to published Japanese Patent), JP-A No. 62-284343 and 2-105135, which are suitable for LED light source and infrared semiconductor laser light source; tricarbocyanine dyes described in JP-A No. 59-191032 and 60-80841 and4-quinoline nucleus-containing dicarbocyanine dyes described in JP-A 59-192242 and 3-67242 [formulas (IIIa) and (IIIb)], which are suitable for an infrared semiconductor laser light source. Further, sensitizing dyes described in JP-A No. 4-182639, 5-341432, JP-B No. 6-52387, 3-10931, U.S. Pat. No. 5,441,866 and JP-A 7-13295 are also employed to respond to infrared laser light of not less than 750 nm, preferably not less than 800 nm. These sensitizing dyes may be used alone or in combination thereof. The combined use of sensitizing dyes is often employed for the purpose of supersensitization. A super-sensitizing compound, such as a dye which does not exhibit spectral sensitization or substance which does not substantially absorb visible light may be incorporated, in combination with a sensitizing dye, into the emulsion.

Crosslinking agents usable in the invention include various commonly known crosslinking agents used for photographic materials, such as aldehyde type, epoxy type, vinylsulfon type, sulfonester type, acryloyl type, carbodiimide type crosslinking agents, as described in JP-A 50-96216. Specifically preferred are an isocyanate type compound, epoxy compound and acid anhydride, as shown below. One of the preferred crosslinking agents is an isocyanate or thioisocyanate compound represented by the following formula:

Formula $$X{=}C{=}N{-}L{-}(N{=}C{=}X)_v$$

wherein v is 1 or 2; L is a bivalent linkage group of an alkylene, alkenylene, arylene or alkylarylene group; and X is an oxygen atom or a sulfur atom. An arylene ring of the arylene group may be substituted. Preferred substituents include a halogen atom (e.g. bromine atom, chlorine atom), hydroxy, amino, carboxy, alkyl and alkoxyl.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56-5535 at pages 10-12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4,-diisocyanate, diphenylmethane-4,4'-diisocyanate, 2,2'-dimethyldiphenylmethane-4,94-d1socyanate, 3313-dimethoxydiphenylmethane-4,4'-diisocyanate, 4,3'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having upto 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. Of these, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, anti-halation layer or sublayer. Thus it may be incorporated into one or plurality of these layers.

The thioisocyanate type crosslinking agent usable in the invention is to be a compound having a thioisocyanate structure, corresponding to the isocyanates described above.

The crosslinking agents described above are used preferably in an amount of 0.001 to 2 mol, and more preferably 0.005 to 0.5 mol per mol of silver.

Next, the layer arrangement of photothermographic materials used in this invention will be described. The photothermographic material comprises at least one light sensitive layer on a support. There is the light sensitive layer alone on the support or there may be further provided at least a light insensitive layer on the light sensitive layer. To control the amount or wavelength distribution of light transmitted to the light sensitive layer, a filter layer may be provided on the light sensitive layer side or on the opposite side, or a dye or pigment may be incorporated in the light sensitive layer. Dyes used therein are preferably compounds described in JP-A 8-201959. The light sensitive layer may be comprised of plural layers, or the combination of high-speed and low-speed light sensitive layers may be provided. Various additives may be incorporated into the light sensitive layer, light insensitive layer or other component layer(s). Examples thereof include a surfactant, antioxidant, stabilizer, plasticizer, UV absorbent and coating aid.

Next, coating methods relating to the photothermographic material will be described. Coating solutions used for the photothermographic material are preferably filtered prior to their coating. In the filtration, it is preferred to cause the coating solution to pass through a filter material having a absolute or semi-absolute filtering precision of 5 to 50 $\mu$m, once or more.

In coating photothermographic materials used in this invention employed are successive coating methods in which coating and drying of each layer are successively repeated, including, for example, a roll coating system such as reverse roll coating and gravure roll coating, blade coating, wire-bar coating, and die coating. A simultaneous multi-layer coating is also employed, in which before a coated layer is dried, the next layer is coated using plural coaters and the thus coated plural layers are simultaneously dried, or plural coating solutions are simultaneously layered and coated using slide coating, curtain coating or an extrusion type die coater having plural slits, in which the latter coating is preferred in terms of prevention of occurrence of coating troubles caused by impurities incorporated from the outside. In the simultaneous multi-layer coating, to prevent cross-layer contamination, the viscosity of the uppermost layer coating solution is preferably not less than 0.1 Pa·s and that of other layer coating solution is preferably not less than 0.03 Pa·s. When coating solutions of two or more layers are layered, a solid content dissolved in one layer which is insoluble in a solvent used in the adjacent layer tends to cause turbulence or turbidity at the interface. It is therefore preferable that major solvents contained in respective layer coating solutions are identical (or the content of a solvent commonly contained in coating solutions is more than other solvents).

After completion of multiplayer coating, it is preferred to dry as promptly as possible and it is more preferred to complete drying within 10 sec. to avoid cross-layer mixing caused by flow, diffusion or density difference. A hot air drying system, an infrared ray drying system and the like are generally employed and the hot air drying system is preferred, in which the drying temperature is preferably 30 to 100° C.

The thus prepared photothermographic material may be cut to an intended size and packed immediately after completion of drying, alternatively, the photothermographic material may be wound up on the roll and temporarily stocked prior to cutting and packaging. A wind-up system is not specifically limited but a tension control system is generally employed.

Exposure of the photothermographic material is conducted preferably employing argon laser (488 nm), he-ne-laser (633 nm), red semiconductor laser (670 nm), infrared semiconductor laser (780 nm, 820 nm). Of these, infrared semiconductor laser is preferred in terms of being high power and transparent to the photothermographic material.

In the invention, exposure is preferably conducted by laser scanning exposure. It is also preferred to use a laser exposure apparatus, in which a scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 $\mu$m, and more preferably not more than 100 $\mu$m. Thus, a smaller spot diameter preferably reduces the angle displacing from verticality of the laser incident angle. The lower limit of the beam spot diameter is 10 $\mu$m. The thus laser scanning exposure can reduce deterioration in image quality due to reflected light, resulting in occurrence such as interference fringe-like unevenness.

Exposure applicable in the invention is conducted preferably using a laser scanning exposure apparatus producing longitudinally multiple scanning laser beams, whereby deterioration in image quality such as occurrence of interference fringe-like unevenness is reduced, as compared to a scanning laser beam of the longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

Photothermographic materials used in this invention are stable at ordinary temperature and are developed upon being heated at a high temperature after exposure. The heating temperature is preferably 80 to 200° C., and more preferably 100 to 150° C. Heating at a temperature lower than 80° C. results in images with insufficient densities and at the heating temperature higher than 200° C., the binder melts, adversely affecting not only images but also transportability and a thermal processor. On heating, oxidation-reduction reaction between an organic silver salt (acting as an oxidant) and a reducing agent is caused to form silver images. This reaction process proceeds without supply of water from the outside.

EXAMPLES

The present invention will be further described based on examples but the invention is by no means limited to these examples.

Example 1

| Preparation of light sensitive silver halide emulsion 1 | |
|---|---|
| Solution A | |
| Phenylcarbomoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Solution E1 | |
| 0.4 mol/l aqueous potassium bromide solution Amount necessary to adjust silver potential | |
| Solution F1 | |
| Aqueous 56% acetic acid solution | 16 ml |
| Solution G1 | |
| Anhydrous sodium carbonate | 1.72 g |
| Water to make | 151 ml |

Compound (A) $HO(CH_2CH_2O)_n—(CH(CH_3)CH_2O)_{17}—(CH_2CH_2O)_mH$ (m + n = 5 to 7)

Using a stirring mixer described in JP-B 58-58288 and 58-58289, ¼ of solution B1, the total amount of solution C1 were added to solution Al by the double jet addition for 4 min 45 sec. to form nucleus grain, while maintaining a temperature of 45° C. and a pAg of 8.09. After 7 min, ¾ of solution B1 and the total amount of solution D1 were further added by the double jet addition for 14 min 15 sec., while mainlining a temperature of 450° C., a pAg of 8.09 and a pH of 5.6. After stirring for 5 min., the reaction mixture was lowered to 40° C. and solution F1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution G1 was added. The temperature was raised to 60° C. and stirring continued for 120 min. Finally, the pH was adjusted to 5.8 and water was added there to so that the weight per mol of silver was 1161 g and light-sensitive silver halide emulsion 1 was thus obtained. It was proved that the resulting emulsion was comprised of monodisperse silver iodobromide cubic grains having an average equivalent sphere diameter of 0.058 μm, a coefficient of variation of grain size of 12% and a (100) face proportion of 92%. Amounts of iridium contained within and outside the silver halide grain were $8.2\times10^{-6}$ mol and $1.6\times10^{-6}$ mol per mol of silver, respectively. The gelatin content of the emulsion was 42.5 g per mol of silver.

Then, to the emulsion was added 240 ml of 0.5% triphenyphosphine oxide methanol solution and after adding 1/20 equimolar gold compound described below (0.5% methanol solution), the emulsion was chemically sensitized with stirring at a temperature of 55° C. for 120 min. Preparation of light sensitive silver halide emulsions 2 to 7 Light sensitive silver halide emulsions 2 through 7 were prepared in a manner similar to silver halide emulsion 1, except that the mixing temperature and the addition time of ¼ of the solution (B1) and the total of the solution (C1) were varied. Each of the thus prepared emulsions was comprised of cubic silver iodobromide grains exhibiting the average grain size (equivalent sphere diameter), coefficient of variation of grain size and [100] face proportion shown in Table 1. The amount of iridium contained in silver halide grains and the gelatin content were the same as silver halide emulsion 1.

Emulsions 2 through 7 were each subjected to chemical sensitization similarly to emulsion 1.

TABLE 1

| Emulsion No. | Mixing Temp. (° C.) | Nucleation Time | Gelatin Content of Solution Al (g) | Av. Grain Size (μm) | C.V. of Grain Size*1 | [100] Face | Gelatin Content |
|---|---|---|---|---|---|---|---|
| 1 | 45 | 4 min 45 sec | 88.3 | 0.058 | 12% | 92% | 42.5 |
| 2 | 45 | 1 min 11 sec | 88.3 | 0.048 | 12% | 92% | 42.5 |
| 3 | 45 | 24 sec | 88.3 | 0.040 | 12% | 92% | 42.5 |
| 4 | 38 | 24 sec | 88.3 | 0.030 | 12% | 92% | 42.5 |
| 5 | 47 | 4 min 45 sec | 88.3 | 0.068 | 12% | 92% | 42.5 |
| 6 | 45 | 15 min | 88.3 | 0.076 | 12% | 92% | 42.5 |
| 7 | 47 | 15 min | 88.3 | 0.080 | 12% | 92% | 42.5 |

*1Coefficient of variation of grain size preparation of powdery organic silver salt In 4720 ml water were dissolved 111.4 g of behenic acid 83.8 g of arachidic acid and 54.9 g of stearic acid at 80° C.

The, after adding 540.2 ml of 1.5 M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion (equivalent to 0.038 mol silver) and 450 ml water and stirring further continued for 5 min., while maintained at a temperature of 55° C. Subsequently, 702.6 ml of 1 M aqueous silver nitrate solution was added in 2 min. and stirring continued further for 10 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 40° C. until no reduction in weight was detected to obtain a powdery organic silver salt. using silver halide emulsion 2 through 7, powdery organic silver salts 2 through 7 were similarly prepared.

Similarly, powdery organic silver salts 8 through 21 were prepared, provided that the amount of the light sensitive silver halide emulsion was varied as shown in Table 2.

Preparation of Preliminarily Dispersed Solution

In 1457 g methyl ethyl ketone was dissolved 14.57 g of polyvinyl butyral powder (Butvar B-79, available from Monsanto Corp.) and further thereto, 500 g of the powdery organic silver salt with stirring by dissolver DISPERMAT CA-40 M type (available from VMA-GETZMANN Corp.) was gradually added to obtain a preliminarily dispersed solutions Nos. 1 through 21.

Preparation of Light Sensitive Emulsified Solution

Thereafter, using a pump, the thus dispersed solution No. 1 through 21 were each supplied to a media type dispersing machine DISPERMAT SL-C12 Type EX (available from GETZMANN Corp.), which was packed 0.5 mm zirconia beads (available from Toray Co. Ltd.) by 80%, and dispersed at a circumferential speed of 13 m and for 0.5 min. of a retention time with a mill to obtain light sensitive emulsion-dispersing solutions No. 1 through 21.

Preparation of Stabilizer Solution

Stabilizer 1 of 1.0 g and 0.31 g of potassium acetate were dissolved in 4.97 g of methanol to obtain a stabilizer solution.

Preparation of Infrared Sensitizing Dye Solution

Infrared sensitizing dye 1 of 19.2 mg 1.488 g of 2-chlorobenzoic acid, 2.779 g of stabilizer 2 and 365 mg of 5-methyl-2-mercaptobenzimidazole were dissolved in 31.3 ml of MEK in the dark room to obtain an infrared sensitizing dye solution.

Preparation of Addition Solution a

Reducing agent A-3 of 27.98 g, 1.54 g of 4-methylphthalic acid and 0.48 g of infrared dye 1 were dissolved in 110 g of MEK to obtain addition solution a.

Preparation of Addition Solution b

Antifoggant 2 of 3.56 g was dissolved in 40.9 g of MEK to obtain addition solution b.

Preparation of Light Sensitive Layer Coating Solution

The light-sensitive emulsion-dispersed solution of 50 g and 15.11 g MEK were maintained at 21° C. with stirring. Then, 390 μl of antifoggant 1 solution (10% by weight methanol solution) was added and stirred for 1 hr. and 494 μl of calcium bromide solution (10% by weight methanol solution) was added and further stirred for 20 min. Subsequently, 167 mg of the stabilizer solution was further added thereto and after stirring for 10 min., 2.622 mg of the infrared sensitizing dye solution was added, stirred for 10 min. Then, the reaction mixture was cooled to 13° C. and further stirred for 30 min.

Further, 13.31 g of polyvinyl butyral (Butvar B-79, available from Monsanto Corp.) was added thereto and after 30 min., 1.084 g of tetrachlorophthalic acid (13% by weight MEK solution) was added and stirred for 15 min. Then, 12.43 g of addition solution a, 1.6 ml of 10% by weight MEK solution of aliphatic isocyanate compound (Desmodur N3300, available from Movey Co.), and 4.37 g of addition solution b were successively added with stirring to obtain light sensitive layer coating solution Nos. 1 through 21.

Preparation of Matting Agent Dispersion

Cellulose acetate butyrate (7.5 g of CAB171-15, available from Eastman Chemical Co.) was dissolved in 42.5 g of MEK, then, 5 g of calcium carbonate (Super-Pflex 200, available from Speciality Mineral Corp.) was added thereto and dispersed using a dissolver type homogenizer at 8000 rpm for 30 min to obtain a matting agent dispersion.

Preparation of Protective Layer Coating Solution

To 865 g of methyl ethyl ketone were added with stirring 96 g of cellulose acetate butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfone compound shown below, 1.0 g of benzotriazole and 1.0 g of fluorinated surfactant (Surflon KH40, available from ASAHI Glass Co. Ltd.). Then, 30 g of the matting agent dispersion was further added thereto to obtain a coating solution of the surface protective layer. Coating of light sensitive layer side Viscosities of the light sensitive layer coating solution and protective layer coating solution were each adjusted to 0.228 Pa·s and 0.184 Pa·s, respectively by adjusting the solvent content. After filtered with a filter of semi-complete filtration precision of 20 μm, the coating solutions extruded from an extrusion type die coater were simultaneously coated on the support using. After 8 sec., coated layers were dried with hot air of dry bulb temperature of 75° C. and dew point of 10° C. for a period of 5 min. and wound up in a roll form at a tension of 196 N/m (20 kg/m) in an atmosphere of 23° C. and 50% RH to obtain photothermographic material samples Nos. 1 through 21. The thus obtained photothermographic material exhibited a silver coverage of the light sensitive layer of ⅙ g/m$^2$ and a dry layer of 2.5 μm.

Stabilizer 1

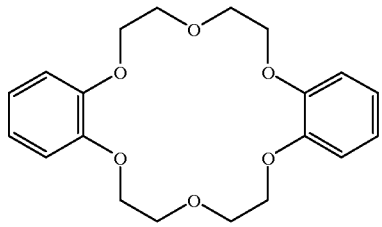

Infrared sensitizing dye 1

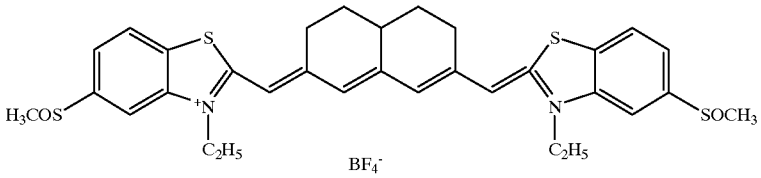

Antifoggant 1

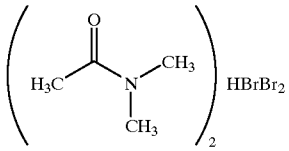

Antifoggant 2

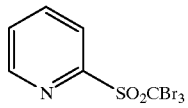

Developer A-3

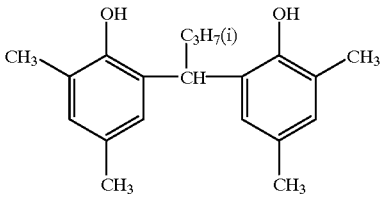

Infrared dye 1

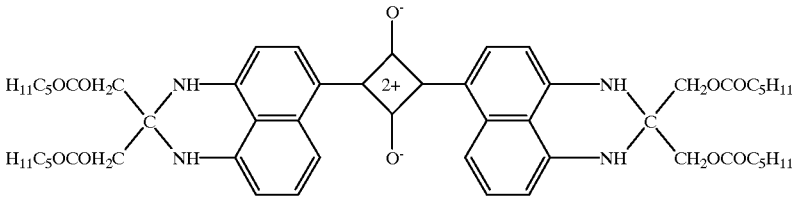

Vinylsulfon compound (HD-1)

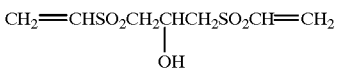

Stabilizer 2

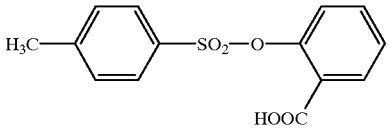

Sensitometry Evaluation

The thus prepared photothermographic material samples were each subjected to laser scanning exposure from the emulsion side using an exposure apparatus having a light source of 800 to 820 nm semiconductor laser of a longitudinal multi-mode, which was made by means of high frequency overlapping. In this case, exposure was conducted at 75° of an angle between the exposed surface and exposing laser light. The exposed photothermographic material was subjected to thermal development at 115° C. for 15 sec., while bringing the protective layer surface of the photothermographic material into contact with the heated drum surface. Exposure and thermal development were carried out in an atmosphere of 23° C. and 50% RH. The thus processed samples were evaluated with respect to sensitivity (also denoted as "S") and fog density (also denoted as "Fog"). Sensitivity was represented by a relative value of the reciprocal of exposure giving a density of 1.0 plus a density of an unexposed area, based on the sensitivity of photothermographic material sample 1 being 100. Results are shown in Table 2.

Evaluation of Image Quality

The portion exhibiting a density of 1.0 of each developed sample was microscopically observed using a microscope (available from MITSUTOYO Co., Ltd.) at a transmission mode and 100 power, with respect to deteriorated image quality caused by white spots and coagula, based on the following criteria:

4: no white spot and coagulum was observed and superior image quality,

3: white spots and coagula were slightly observed and no problem in image quality, 2: white spots and coagula were observed but an image quality acceptable as a product, 1: marked white spots and coagula were observed and unacceptable levels as a product.

a light-shielded room at 25° C. and 55% RH for 7 days and the other sheet was allowed to stand at 25° C. and 55% RH for 7 days, while being exposed to natural light. Thereafter, aged samples were measured with respect to fogging, based on an increase of fog density, as defined below:

Fog increase (ΔFog)=a fog density resulted when exposed natural light minus a fog density resulted when aged under light-shielding.

Further, both sheet samples were evaluated with respect a to silver image color, based on the following criteria:

5: neutral black tone and no yellowish tone was observed,

4: not neutral black tone but yellowish tone was scarcely observed,

3: yellowish tone was slightly observed

2: slightly yellowish tone was overall observed, and

1: yellowish tone was apparently observed.

Results are shown in Table 2.

TABLE 2

| Sample No. | Emulsion No. | Av. Grain Size (μm) | Gelatin Content (g/mol Agx) | AgX (g)*1 | AgX/Org. Ag*2 | *3 Binder (g) | Sensitometry Fog | Sensitometry S | Image Quality | Raw Stock Stability | Image Lasting Quality ΔFog | Image Lasting Quality Image Color | Remark |
|---|---|---|---|---|---|---|---|---|---|---|---|---|---|
| 1 | 1 | 0.058 | 42.5 | 45.3 | $1.59 \times 10^{16}$ | 2.34 | 0.08 | 100 | 4 | 0.05 | 0.03 | 2 | Comp. |
| 2 | 2 | 0.048 | 42.5 | 45.3 | $2.80 \times 10^{16}$ | 2.34 | 0.07 | 110 | 4 | 0.06 | 0.04 | 3 | Comp. |
| 3 | 3 | 0.040 | 42.5 | 45.3 | $4.84 \times 10^{16}$ | 2.34 | 0.07 | 120 | 4 | 0.08 | 0.05 | 3 | Comp. |
| 4 | 4 | 0.030 | 42.5 | 45.3 | $1.15 \times 10^{17}$ | 2.34 | 0.06 | 125 | 4 | 0.10 | 0.07 | 2 | Comp. |
| 5 | 5 | 0.068 | 42.5 | 45.3 | $9.84 \times 10^{15}$ | 2.34 | 0.10 | 95 | 4 | 0.04 | 0.02 | 2 | Comp. |
| 6 | 6 | 0.076 | 42.5 | 45.3 | $7.05 \times 10^{15}$ | 2.34 | 0.12 | 85 | 4 | 0.04 | 0.02 | 1 | Comp. |
| 7 | 7 | 0.080 | 42.5 | 45.3 | $6.04 \times 10^{15}$ | 2.34 | 0.15 | 80 | 4 | 0.03 | 0.02 | 1 | Comp. |
| 8 | 1 | 0.058 | 42.5 | 16.5 | $5.77 \times 10^{15}$ | 0.85 | 0.06 | 120 | 4 | 0.02 | 0.01 | 3 | Comp. |
| 9 | 2 | 0.048 | 42.5 | 16.5 | $1.02 \times 10^{16}$ | 0.85 | 0.02 | 150 | 4 | 0.02 | 0.01 | 5 | Inv. |
| 10 | 3 | 0.040 | 42.5 | 16.5 | $1.76 \times 10^{16}$ | 0.85 | 0.01 | 160 | 4 | 0.02 | 0.01 | 5 | Inv. |
| 11 | 4 | 0.030 | 42.5 | 16.5 | $4.17 \times 10^{16}$ | 0.85 | 0.01 | 160 | 4 | 0.02 | 0.01 | 5 | Inv. |
| 12 | 5 | 0.068 | 42.5 | 16.5 | $3.58 \times 10^{15}$ | 0.85 | 0.08 | 110 | 4 | 0.02 | 0.01 | 3 | Comp. |
| 13 | 6 | 0.076 | 42.5 | 16.5 | $2.56 \times 10^{15}$ | 0.85 | 0.10 | 100 | 4 | 0.02 | 0.01 | 2 | Comp. |
| 14 | 7 | 0.080 | 42.5 | 16.5 | $2.20 \times 10^{15}$ | 0.85 | 0.12 | 95 | 4 | 0.02 | 0.01 | 1 | Comp. |
| 15 | 1 | 0.058 | 42.5 | 82.4 | $2.88 \times 10^{16}$ | 4.25 | 0.04 | 65 | 4 | 0.03 | 0.02 | 3 | Comp. |
| 16 | 2 | 0.048 | 42.5 | 82.4 | $5.09 \times 10^{16}$ | 4.25 | 0.04 | 70 | 4 | 0.04 | 0.03 | 3 | Comp. |
| 17 | 3 | 0.040 | 42.5 | 82.4 | $8.79 \times 10^{16}$ | 4.25 | 0.03 | 80 | 4 | 0.06 | 0.04 | 3 | Comp. |
| 18 | 4 | 0.030 | 42.5 | 82.4 | $2.08 \times 10^{17}$ | 4.25 | 0.03 | 88 | 4 | 0.08 | 0.06 | 2 | Comp. |
| 19 | 5 | 0.068 | 42.5 | 82.4 | $1.79 \times 10^{16}$ | 4.25 | 0.06 | 60 | 4 | 0.03 | 0.02 | 2 | Comp. |
| 20 | 6 | 0.076 | 42.5 | 82.4 | $1.28 \times 10^{16}$ | 4.25 | 0.08 | 53 | 4 | 0.03 | 0.02 | 2 | Comp. |

*1amount of silver halide emulsion added at the time of forming an organic silver salt.
*2ratio of the number of added silver halide grains per mol of organic silver salt.
*3hydrophilic binder contained in photothermographic material per mol of organic silver salt Evaluation of Row Stock Stability Photothermographic material samples were allowed to stand under the following conditions (A) and (B) for 10 days, and similarly subjected to exposure, thermal development and sensitometry. Samples were evaluated with respect to raw stock stability, based on the difference in fog density between conditions (A) and (B), i.e. fog (B) minus fog (A):

Condition (A): 25° C., 55% RH,

Condition (B): 40° C., 80% RH.

Evaluation of Image Lasting Quality 2 sheets of each sample were processed similarly to the sensitometry evaluation. One sheet was allowed to stand in As can be seen from Table 1, inventive photothermographic material samples exhibited enhanced sensitivity, reduced fogging, improved raw stock stability and superior image lasting quality.

Example 2

Photothermographic material samples were prepared similarly to Example 1, provide that in the process of preparing the light sensitive silver halide emulsion, the amount of phenylcarbomoyl gelatin in solution Al was varied as shown in Table 3. The thus prepared samples were evaluated similar to Example 1 and the results thereof are shown in Tables 4 and 5.

TABLE 3

| Emulsion No. | Mixing Temp. (° C.) | Nucleation Time | Gelatin Content of Solution Al (g) | Av. Grain Size (μm) | C.V. of Grain Size*1 | [100] Face | Gelatin Content |
|---|---|---|---|---|---|---|---|
| 8 | 45 | 4 min 45 sec | 71.2 | 0.058 | 12% | 92% | 34.0 |
| 9 | 45 | 1 min 11 sec | 71.2 | 0.048 | 12% | 92% | 34.0 |
| 10 | 45 | 24 sec | 71.2 | 0.040 | 12% | 92% | 34.0 |
| 11 | 38 | 24 sec | 71.2 | 0.030 | 12% | 92% | 34.0 |
| 12 | 47 | 4 min 45 sec | 71.2 | 0.068 | 12% | 92% | 34.0 |
| 13 | 45 | 15 min | 71.2 | 0.076 | 12% | 92% | 34.0 |
| 14 | 47 | 15 min | 71.2 | 0.080 | 12% | 92% | 34.0 |
| 15 | 45 | 4 min 45 sec | 41.3 | 0.058 | 12% | 92% | 19.8 |
| 16 | 45 | 1 min 11 sec | 41.3 | 0.048 | 12% | 92% | 19.8 |
| 17 | 45 | 24 sec | 41.3 | 0.040 | 12% | 92% | 19.8 |
| 18 | 38 | 24 sec | 41.3 | 0.030 | 12% | 92% | 19.8 |
| 19 | 47 | 4 min 45 sec | 41.3 | 0.068 | 12% | 92% | 19.8 |
| 20 | 45 | 15 min | 41.3 | 0.076 | 12% | 92% | 19.8 |
| 21 | 47 | 15 min | 41.3 | 0.080 | 12% | 92% | 19.8 |
| 22 | 45 | 4 min 45 sec | 19.4 | 0.058 | 12% | 92% | 9.1 |
| 23 | 45 | 1 min 11 sec | 19.4 | 0.048 | 12% | 92% | 9.1 |
| 24 | 45 | 24 sec | 19.4 | 0.040 | 12% | 92% | 9.1 |
| 25 | 38 | 24 sec | 19.4 | 0.030 | 12% | 92% | 9.1 |
| 26 | 47 | 4 min 45 sec | 19.4 | 0.068 | 12% | 92% | 9.1 |
| 27 | 45 | 15 min | 19.4 | 0.076 | 12% | 92% | 9.1 |
| 28 | 47 | 15 min | 19.4 | 0.080 | 12% | 92% | 9.1 |
| 29 | 45 | 4 min 45 sec | 10.9 | 0.058 | 12% | 92% | 5.1 |
| 30 | 45 | 1 min 11 sec | 10.9 | 0.048 | 12% | 92% | 5.1 |
| 31 | 45 | 24 sec | 10.9 | 0.040 | 12% | 92% | 5.1 |
| 32 | 38 | 24 sec | 10.9 | 0.030 | 12% | 92% | 5.1 |
| 33 | 47 | 4 min 45 sec | 10.9 | 0.068 | 12% | 92% | 5.1 |
| 34 | 45 | 15 min | 10.9 | 0.076 | 12% | 92% | 5.1 |
| 35 | 47 | 15 min | 10.9 | 0.080 | 12% | 92% | 5.1 |

TABLE 4

| Sample No. | Emulsion No. | Av. Grain Size (μm) | Gelatin Content (g/mol Ag) | AgX (g)*1 | AgX/Org. Ag*2 | Gelatin*3 (g) | Sensitometry Fog | Sensitometry S | Image Quality | Raw Stock Stability | Image Lasting Quality ΔFog | Image Lasting Quality Image Color | Remark |
|---|---|---|---|---|---|---|---|---|---|---|---|---|---|
| 22 | 8 | 0.058 | 34.0 | 45.3 | $1.59 \times 10^{16}$ | 1.87 | 0.02 | 130 | 4 | 0.02 | 0.02 | 5 | Inv. |
| 23 | 9 | 0.048 | 34.0 | 45.3 | $2.80 \times 10^{16}$ | 1.87 | 0.02 | 135 | 4 | 0.02 | 0.02 | 5 | Inv. |
| 24 | 10 | 0.040 | 34.0 | 45.3 | $4.84 \times 10^{16}$ | 1.87 | 0.02 | 135 | 4 | 0.02 | 0.02 | 5 | Inv. |
| 25 | 11 | 0.030 | 34.0 | 45.3 | $1.15 \times 10^{17}$ | 1.87 | 0.02 | 134 | 4 | 0.02 | 0.01 | 5 | Inv. |
| 26 | 12 | 0.068 | 34.0 | 45.3 | $9.84 \times 10^{15}$ | 1.87 | 0.03 | 125 | 4 | 0.02 | 0.01 | 5 | Inv. |
| 27 | 13 | 0.076 | 34.0 | 45.3 | $7.05 \times 10^{15}$ | 1.87 | 0.03 | 123 | 4 | 0.02 | 0.01 | 5 | Inv. |
| 28 | 14 | 0.080 | 34.0 | 45.3 | $6.04 \times 10^{15}$ | 1.87 | 0.08 | 82 | 4 | 0.04 | 0.05 | 4 | Comp. |
| 29 | 15 | 0.058 | 19.8 | 45.3 | $1.59 \times 10^{16}$ | 1.09 | 0.02 | 140 | 4 | 0.02 | 0.01 | 5 | Inv. |
| 30 | 16 | 0.048 | 19.8 | 45.3 | $2.80 \times 10^{16}$ | 1.09 | 0.02 | 145 | 4 | 0.02 | 0.01 | 5 | Inv. |

*1amount of silver halide grains added at the time of forming an organic silver salt.
*2ratio of the number of added silver halide grains per mol of organic silver salt.
*3gelatin content of photothermographic material per mol of organic silver salt

TABLE 5

| Sample No. | Emulsion No. | Av. Grain Size (μm) | Gelatin Content (g/mol Ag) | AgX (g)*1 | AgX/Org. Ag*2 | Gelatin*3 (g) | Sensitometry Fog | Sensitometry S | Image Quality | Raw Stock Stability | Image Lasting Quality ΔFog | Image Lasting Quality Image Color | Remark |
|---|---|---|---|---|---|---|---|---|---|---|---|---|---|
| 31 | 17 | 0.040 | 19.8 | 45.3 | $4.84 \times 10^{16}$ | 1.09 | 0.02 | 140 | 4 | 0.02 | 0.01 | 5 | Inv. |
| 32 | 18 | 0.030 | 19.8 | 45.3 | $1.15 \times 10^{17}$ | 1.09 | 0.02 | 125 | 4 | 0.02 | 0.01 | 5 | Inv. |
| 33 | 19 | 0.068 | 19.8 | 45.3 | $9.84 \times 10^{15}$ | 1.09 | 0.02 | 135 | 4 | 0.02 | 0.01 | 5 | Inv. |
| 34 | 20 | 0.076 | 19.8 | 45.3 | $7.05 \times 10^{15}$ | 1.09 | 0.03 | 130 | 4 | 0.02 | 0.01 | 5 | Inv. |
| 35 | 21 | 0.080 | 19.8 | 45.3 | $6.04 \times 10^{15}$ | 1.09 | 0.09 | 85 | 3 | 0.06 | 0.04 | 3 | Comp. |
| 36 | 22 | 0.058 | 9.1 | 45.3 | $1.59 \times 10^{16}$ | 0.50 | 0.02 | 150 | 4 | 0.02 | 0.01 | 5 | Inv. |

TABLE 5-continued

| Sample No. | Emulsion No. | Av. Grain Size (μm) | Gelatin Content (g/mol Ag) | AgX (g)*1 | AgX/Org. Ag*2 | Gelatin*3 (g) | Sensitometry Fog | Sensitometry S | Image Quality | Raw Stock Stability | Image Lasting Quality ΔFog | Image Lasting Quality Image Color | Remark |
|---|---|---|---|---|---|---|---|---|---|---|---|---|---|
| 37 | 23 | 0.048 | 9.1 | 45.3 | $2.80 \times 10^{16}$ | 0.50 | 0.02 | 154 | 4 | 0.02 | 0.01 | 5 | Inv. |
| 38 | 24 | 0.040 | 9.1 | 45.3 | $4.84 \times 10^{16}$ | 0.50 | 0.02 | 148 | 4 | 0.02 | 0.01 | 5 | Inv. |
| 39 | 25 | 0.030 | 9.1 | 45.3 | $1.15 \times 10^{17}$ | 0.50 | 0.02 | 135 | 4 | 0.02 | 0.01 | 5 | Inv. |
| 40 | 26 | 0.068 | 9.1 | 45.3 | $9.84 \times 10^{16}$ | 0.50 | 0.02 | 150 | 4 | 0.02 | 0.01 | 5 | Inv. |
| 41 | 27 | 0.076 | 9.1 | 45.3 | $7.05 \times 10^{13}$ | 0.50 | 0.03 | 148 | 4 | 0.02 | 0.01 | 5 | Inv. |
| 42 | 28 | 0.080 | 9.1 | 45.3 | $6.04 \times 10^{15}$ | 0.50 | 0.13 | 87 | 3 | 0.08 | 0.05 | 2 | Comp. |
| 43 | 29 | 0.058 | 5.1 | 45.3 | $1.59 \times 10^{16}$ | 0.28 | 0.05 | 120 | 2 | 0.24 | 0.21 | 2 | Comp. |
| 44 | 30 | 0.048 | 5.1 | 45.3 | $2.80 \times 10^{16}$ | 0.28 | 0.05 | 123 | 2 | 0.25 | 0.22 | 2 | Comp. |
| 45 | 31 | 0.040 | 5.1 | 45.3 | $4.84 \times 10^{16}$ | 0.28 | 0.04 | 120 | 2 | 0.26 | 0.22 | 2 | Comp. |
| 46 | 32 | 0.030 | 5.1 | 45.3 | $1.15 \times 10^{17}$ | 0.28 | 0.04 | 120 | 2 | 0.23 | 0.21 | 2 | Comp. |
| 47 | 33 | 0.068 | 5.1 | 45.3 | $9.84 \times 10^{15}$ | 0.28 | 0.09 | 115 | 2 | 0.26 | 0.24 | 1 | Comp. |
| 48 | 34 | 0.076 | 5.1 | 45.3 | $7.05 \times 10^{15}$ | 0.28 | 0.13 | 110 | 1 | 0.25 | 0.22 | 1 | Comp. |
| 49 | 35 | 0.080 | 5.1 | 45.3 | $6.04 \times 10^{15}$ | 0.28 | 0.16 | 65 | 1 | 0.28 | 0.25 | 1 | Comp. |

*1amount of silver halide grains added at the time of forming an organic silver salt.
*2ratio of the number of added silver halide grains per mol of organic silver salt.
*3gelatin content of photothermographic material per mol of organic silver salt Inventive photothermographic material samples exhibited enhanced sensitivity, reduced fogging, no deteriorated image quality caused by spots and coagula, improved raw stock stability and superior image lasting quality.

Example 3

Photographic material samples were prepared similarly to Example 2, provide that silver halide emulsions Nos. 8, 10, 15 and 17 were evaluated similar in Table 6. The thus prepared samples were evaluated similar to example 2 and results are shown in Table 6.

TABLE 6

| Sample No. | Emulsion No. | Av. Grain Size (μm) | Gelatin Content (g/mol Ag) | AgX (g)*1 | AgX/Org. Ag*2 | *3 Binder (g) | Sensitometry Fog | Sensitometry S | Image Quality | Raw Stock Stability | Image Lasting Quality ΔFog | Image Lasting Quality Image Color | Remark |
|---|---|---|---|---|---|---|---|---|---|---|---|---|---|
| 50 | 8 | 0.058 | 34.0 | 16.5 | $5.77 \times 10^{15}$ | 0.63 | 0.05 | 90 | 2 | 0.05 | 0.04 | 3 | Comp. |
| 51 | 10 | 0.040 | 34.0 | 16.5 | $1.76 \times 10^{16}$ | 0.68 | 0.02 | 140 | 4 | 0.02 | 0.01 | 5 | Inv. |
| 52 | 15 | 0.058 | 19.8 | 16.5 | $5.77 \times 10^{15}$ | 0.40 | 0.06 | 100 | 1 | 0.05 | 0.04 | 3 | Comp. |
| 53 | 17 | 0.040 | 19.8 | 16.5 | $1.76 \times 10^{16}$ | 0.40 | 0.08 | 120 | 1 | 0.11 | 0.09 | 2 | Comp. |
| 54 | 8 | 0.058 | 34.0 | 82.4 | $2.88 \times 10^{16}$ | 3.40 | 0.05 | 85 | 4 | 0.15 | 0.11 | 2 | Comp. |
| 55 | 10 | 0.040 | 34.0 | 82.4 | $8.79 \times 10^{16}$ | 3.40 | 0.05 | 90 | 4 | 0.12 | 0.09 | 1 | Comp. |
| 56 | 15 | 0.058 | 19.8 | 82.4 | $2.88 \times 10^{16}$ | 1.98 | 0.02 | 138 | 4 | 0.02 | 0.01 | 5 | Inv. |
| 57 | 17 | 0.040 | 19.8 | 82.4 | $8.79 \times 10^{16}$ | 1.98 | 0.04 | 100 | 3 | 0.09 | 0.06 | 2 | Comp. |

*1amount of silver halide grains added at the time of forming an organic silver salt.
*2ratio of the number of added silver halide grains per mol of organic silver salt.
*3hydrophilic binder contained in photothermographic material per mol of organic silver salt Inventive photothermographic material samples exhibited enhanced sensitivity, reduced fogging, no deteriorated image quality caused by white spots and coagula, improved raw stock stability and superior image lasting quality, as compared to comparative samples.

Example 4

Photothermographic material samples were prepared and evaluated similarly to Example 1, provided that the halide composition of the light sensitive silver halide emulsion was varied by varying the ratio of potassium bromide to potassium iodide in the preparation of silver halide emulsions.

As a result, inventive photothermographic material samples exhibited enhanced sensitivity, reduced fogging, no deteriorated image quality caused by white spots and coagula, improved raw stock stability and superior image lasting quality. It was specifically noted that the iodide content of 5 mol % or more exhibited the tendency for sensitivity to decrease.

Example 5

Photothermographic material samples were prepared and evaluated similarly to Example 1, provided that solution (D1) was divided and timing of adding iridium chloride was in the preparation of silver halide emulsions.

As a result, inventive photothermographic material samples exhibited enhanced sensitivity, reduced fogging, no deteriorated image quality caused by white spots and coagula, improved raw stock stability and superior image lasting quality. It was specifically noted that addition of iridium chloride at the time of exceeding ½ of the grain volume exhibited the tendency for sensitivity to increase.

Example 6

Photothermographic material samples were prepared and evaluated similarly to Example 5, provided that iridium chloride was replaced by rhodium chloride and ruthenium chloride in the preparation of silver halide emulsions.

As a result, inventive photothermographic material samples exhibited enhanced sensitivity, reduced fogging, no deteriorated image quality caused by white spots and coagula, improved raw stock stability and superior image lasting quality.

Example 7

Preparation of Photographic Support Polyethylene terephthalate (hereinafter, also simply denoted as PET) photographic support was prepared in the following manner.

Both sides of a blue-tinted 175 μm thick polyethylene terephthalate film base exhibiting a blue density of 0.170 (densitometer PDA-65, available from Konica Corp.) was subjected to corona discharging at 8 $W/m^2$ min. Preparation of Light Sensitive Silver Halide Emulsion A In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 10 percent, and the proportion of the {100} face of 87 percent.

The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Preparation of Light Sensitive Silver Halide Emulsion B

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 62 g silver nitrate and an equimolar aqueous solution containing potassium bromide, potassium iodide (in a molar ratio of 98 to 2) and $1\times10^{-4}$ mol/mol Ag of iridium chloride were added over a period of 9 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 10 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion B.

Preparation of Powdery Organic Silver Salt A

In 4720 ml water were dissolved 111.4 g of behenic acid, 83.8 g of arachidic acid and 54.9 g of stearic acid at 80° C. The, after adding 540.2 ml of 1.5 M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion (equivalent to 0.038 mol silver) and 450 ml water and stirring further continued for 5 min., while maintained at a temperature of 55° C. Subsequently, 760.6 ml of 1 M aqueous silver nitrate solution was added in 2 min. and stirring continued further for 10 min., then, the reaction mixture was filtered to remove aqueous soluble salts. The obtained organic silver salt dispersion was put into a washing vessel and deionized water was added with stirring. Thereafter, the dispersion was allowed to stand and separate float of the organic silver salt dispersion from the reaction mixture to remove the lower soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain a powdery organic silver salt A. In preparing the organic silver salt, a hydrophilic binder (gelatin) of 0.95 g per mol of organic silver salt and light sensitive silver halide of $1.5\times10^{16}$ grains per mol of organic silver salt were concurrently present.

Preparation of Powdery Organic Silver Salt B

Powdery organic silver salt B was prepared similarly to silver salt A, except that light sensitive silver halide emulsion B was used in place of silver halide emulsion A. In preparing the organic silver salt, a hydrophilic binder (gelatin) of 1.13 g per mol of organic silver salt and light sensitive silver halide of $2.6\times10^{16}$ grains per mol of organic silver salt were concurrently present.

Preparation of Preliminarily Dispersed Solution A

In 1457 g methyl ethyl ketone was dissolved 14.57 g of polyvinyl butyral powder (Butvar B-79, available from Monsanto Corp.) and further thereto, 500 g of the powdery organic silver salt A was gradually added with stirring by dissolver DISPERMAT CA-40M type (available from VMA-GETZMANN Corp.) to obtain preliminary dispersion A.

Preparation of Preliminarily Dispersed Solution B

Preliminarily dispersed solution B was prepared similarly to dispersed solution A, except that powdery organic silver salt A was replaced by powdery organic silver salt B.

Preparation of Light-Sensitive Emulsion Dispersing Solution 1

Preliminary dispersion A was supplied to a media type dispersion machine, DISPERMAT SL-C12EX (available from VMA-GETMANN Corp.), which was packed 0.5 mm in diameter Zirconia beads (available from Toray Co. Ltd.) by 80%, and dispersed at a circumferential speed of 13 m/s for 10 min. and 0.7 min. of a retention time in the mill to obtain light sensitive emulsion dispersing solution 1.

Preparation of Light-Sensitive Emulsion Dispersing Solution 2

Using pressure homogenizer type GM-2 (available from S. M. T. Corp.), preliminary dispersion A was subjected to two-pass dispersion to obtain light sensitive emulsion dispersing solution 3, in which the treatment pressure at the first pass was 27.46 MPa and that of the second pass was 54.92 MPa.

Preparation of Light-Sensitive Emulsion Dispersing Solution 3

Light sensitive emulsion dispersing solution 3 was prepared similarly to dispersing solution 2, provided that four times of total treatments was conducted and after the second pass, the treatment pressure was 54.92 MPa.

Preparation of Light-Sensitive Emulsion Dispersing Solution 4

Light sensitive emulsion dispersing solution 4 was prepared similarly to dispersing solution 1, provided that the retention time in the mill was varied to 3 min.

Preparation of Light-Sensitive Emulsion Dispersing Solution 5

Light sensitive emulsion dispersing solution 5 was prepared similarly to dispersing solution 4, provided that preliminary dispersion A was replaced by preliminary dispersion B.

Preparation of Infrared Sensitizing Dye Solution

Infrared sensitizing dye 1 of 350 mg, 13.96 g of 2-chlorobebzoic acid and 2.14 g of 5-methyl-2-mercaptobenzimidazole were dissolved in 73.4 g of methanol in a dark room to obtain an infrared sensitizing dye solution.

Preparation of Stabilizer Solution

Stabilizer 1 of 1.0 g and 0.5 g of potassium acetate were dissolved in 8.5 g of methanol to obtain a stabilizer solution.

Preparation of Developer Solution

Developing agent 1,1-bis(2-hydroxy-3,5-dimethylphenyl)-2-methylpropane of 17.74 g was dissolved in methyl ethyl ketone (also denoted as MEK) to make 100 ml of a developer solution.

Preparation of Antifoggant Solution

Antifoggant 2 of 5.81 g was dissolved in methyl ethyl ketone to make 100 ml of a stabilizer solution.

Preparation of Image Forming Layer Coating Solution

Light sensitive emulsion dispersing solution 1 of 50 g was maintained at 21° C. with stirring, 1000 μl of 10% methanol solution of chemical sensitizer described in Table 7 and after 2 min., 390 μl of 10% antifoggant 1 methanol solution was added thereto and stirred for 1 hr. Further thereto, 889 μm of 10% calcium bromide methanol solution of calcium bromide was added and stirred for 30 min. Subsequently, 1.416 ml of infrared sensitizing dye solution and 667 μl of stabilizer solution were added thereto and stirred for 1 hr. and then cooled to a temperature of 13° C. and further stirred for 30 min. Further, 13.3 g of polyvinyl butyral (Butvar B-79, available from Monsanto Co., Tg=64° C.) was added thereto and sufficiently dissolved with stirring for 30 min., while maintaining the temperature at 13° C.; then, the following additives were added at intervals of 15 min.

| | |
|---|---|
| Phthalazine | 305 mg |
| Tetrachlorophthalic acid | 102 mg |
| 4-Methylphthalic acid | 137 mg |
| Infrared dye 1 | 37 mg |

Then, after stirring for 15 min., the following additives were successively added with stirring to obtain a light sensitive layer coating solution 1:

| | |
|---|---|
| Antifoggant solution (above-described) | 5.47 ml |
| Developer solution (above-described) | 14.06 ml |
| Desmodur N3300 (aliphatic isocyanate, 10% MEK solution, available from Movey Co.) | 1.60 ml |

Similarly, light sensitive layer coating solution was prepared, provided that light sensitive emulsion dispersing solution 2 was used in place of emulsion dispersing solution 1.

Light sensitive layer coating solutions 3 through 7 were prepared similarly to light sensitive layer coating solution 1, provided that light sensitive emulsion dispersing solutions shown in Table 7 were used and stirring was conducted using a high-speed rotary centrifugal type stirrer (dissolver).

Coating of Backing Layer-Side

To 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1 and 4.5 g fluorinated surfactant (Surflon KH40, available from ASAHI Glass Co. Ltd.) and 2.3 g fluorinated surfactant (Megafac F120K, available from DAINIPPON INK Co. Ltd.) which were dissolved in 43.2 g methanol, were added thereto and stirred until being dissolved. Then, 75 g of silica (Siloid 64×6000, available from W.R. Grace Corp.), which was dispersed in methyl ethyl ketone in a concentration of 1 wt % using a dissolver type homogenizer, was further added thereto with stirring to obtain a coating solution A for backing layer.

On the support, the following layers were successively coated to prepare photothermographic materials 1 through 7, in which light sensitive layer coating solutions 1 through 7 were each employed. Drying was carried out at 75° C. for 5 min.

Backing Layer-Side Coating

The prepared backing layer coating solution was coated so as to form a dry thickness of 3.5 μm by means of an extrusion coater and dried at a drying temperature of 100° C. and a dew point of 10° C.

Light Sensitive Layer-Side Coating

The light sensitive layer coating solutions were coated so as to have a silver coverage of 2 g/M$^2$.

Further, the following composition was coated on the light sensitive layer to form a surface protective layer:

| | |
|---|---|
| Methyl ethyl ketone | 17 ml/m$^2$ |
| Cellulose acetate | 2.3 g/m$^2$ |
| Matting agent (monodisperse silica exhibiting a monodispersity of 10% and an average particle size of 4 μm) | 70 mg/m$^2$ |

Measurement of Solvent Content of Film

Film samples were each evaluated with respect to the solvent content. Thus, sample films were each cut to an area of 46.3 cm$^2$, further finely cut to about 5 mm, placed into a specified vial, which was closely packed with septum and aluminum cap, and set to head space sampler HP769 (available Hewlett-Packard Co.), which was connected to gas chromatography (GC) Hewlett-Packard type 5971 provided with a hydrogen flame ion detector (FID). Chromatograms were obtained under the measurement conditions including a head space sampler heating temperature of 120° C. for 20 min., a GC-introducing temperature of 150° C., a column of DB-624 (available from J & W co.) and a temperature-increase of 45°C (3 min.) to 100° C. at a rate of 8°/min. Solvents to be measure were methyl ethyl ketone and methanol. A given amount of each solvent, which was further diluted with butanol was placed into a vial and subjected to the chromatographic measurement in a manner similar to the above. Using a calibration curve prepared from the obtained chromatogram peak area, the solvent content of each film sample was determined. It was proved that the solvent content of all of the photothermographic material samples was substantially identical and effects of the solvent content on characteristics of thermal development of the photothermographic material can be regarded as substantially the same and in fact, no difference was observed with respect to effects on photographic performance.

Exposure and Thermal Processing

Photothermographic material samples were thermally developed by bringing them into contact with a heated drum at 123° C. for 16.5 sec. using a thermal processing system in which Dry Pro Model 722 (available from Konica Corp.) was modified so as to output up to a maximum of 280 $\mu J/cm^2$. In this case, exposure was varied in 20-step intervals from 0 $\mu J/m^2$ of unexposed areas to exposure of 280 $\mu J/m^2$ of the maximum density portions. Exposure and thermal processing were conducted in a room maintained at 23° C. and 50% RH. Processed samples were subjected to densitometry and evaluated with respect to sensitivity and fog density. Sensitivity was represented by a relative value of the reciprocal of exposure giving a density of 1.0 plus a minimum density (corresponding an unexposed area), based on the sensitivity of photothermographic material sample 4 being 100.

Proportion of Silver Halide Grains Not in Contact with Developed Silver

Using a transmission electron microscope (JEM-2000FX, available from NIPPON DENSHI Co., Ltd) at an acceleration voltage of 200 kV, electron micrographs at a magnification of 4,000 were taken for at least 1,000 grains of the raw film and for at least 100 grains of the processed film. The thickness of the picture-taken slice was measured and the number of silver halide grains per 1 $\mu m^2$ was determined. Results are shown in Table 7.

Zr Content

Photothermographic film samples were each cut to 10×10 cm and immersed in methyl ethyl ketone (MEK) to facilitate peeling of the light sensitive layer. The peeled layer was decomposed in sulfuric-nitric acid using a microwave type wet decomposition apparatus (Micro-Digest Type A300, available from Pro Lab Corp.) and analyzed using an inductive-coupled plasma mass spectrometer (PQ-Ω type, available from VG Elemental Corp.), based on the calibration curve method. The obtained Zr content values (mg per g of silver in the light sensitive layer) are shown in Table 7.

Image Lasting Property

Two sheets of each sample were thermally processed similarly to sensitometry and one of them was allowed to stan at 25° C. and 55% RH for days while shielded from light and the other one was allowed to stand at 25° C. and 55% RH for 7 days while exposed to natural light. Thereafter, the aged samples were measured with respect to fog density and evaluated for image lasting property, based on fog increased, as defined below:

Fog increase=(fog density at exposure to natural light−(fog density under light-shielding). Results are shown in Table 7.

TABLE 7

| Sample No. | Emulsion Dispersing Solution | Raw Film: Slice Thickness (μm) | Raw Film: AgX Grains/μm³ | Processed Film: Slice Thickness (μm) | Processed Film: AgX Graind/μm³ | Uncontacted AgX*1 (%) | Zr Content (mg) | Chalcogen Sensitizer | Sensitivity | Fog | Image Lasting Property | Remark |
|---|---|---|---|---|---|---|---|---|---|---|---|---|
| 1 | 1 | 0.25 | 5.45 | 0.20 | 1.56 | 28.6 | 0.06 | None | 77 | 0.22 | 0.019 | Comp. |
| 2 | 2 | 0.25 | 5.40 | 0.20 | 2.09 | 38.7 | 0 | None | 75 | 0.25 | 0.025 | Comp. |
| 3 | 3 | 0.25 | 5.39 | 0.20 | 0.50 | 9.3 | 0 | None | 98 | 0.2 | 0.005 | Inv. |
| 4 | 4 | 0.25 | 5.40 | 0.20 | 0.48 | 8.9 | 0.32 | None | 100 | 0.19 | 0.002 | Inv. |
| 5 | 5 | 0.25 | 10.20 | 0.21 | 1.53 | 15.0 | 0.32 | S-1 | 120 | 0.24 | 0.003 | Inv. |
| 6 | 6 | 0.25 | 10.50 | 0.22 | 1.58 | 15.0 | 0.32 | S-5 | 125 | 0.24 | 0.003 | Inv. |
| 7 | 7 | 0.25 | 10.90 | 0.22 | 1.09 | 10.0 | 0.32 | S-15 | 128 | 0.23 | 0.003 | Inv. |

*1Percentage by number of silver halide grains uncontacted with developed silver As can be seen from Table 7, inventive samples exhibited enhanced sensitive, low fogging and superior image lasting property.

What is claimed is:

1. A photothermographic material comprising an organic silver salt, light sensitive silver halide grains and a hydrophilic binder in an amount of 0.5 to 2 g per mol of the organic silver salt; and wherein the organic silver salt was formed in the presence of $7\times10^{15}$ to $3\times10^{17}$ of the silver halide grains per mol of the organic silver salt which is formed, and the silver halide grains having an average equivalent sphere diameter of 0.03 to 0.07 μm.

2. The photothermographic material of claim 1, wherein the light sensitive silver halide is comprised of light sensitive silver halide grains having an average equivalent sphere diameter of 0.04 to 0.07 μm.

3. The photothermographic material of claim 1, wherein the formed organic silver salt is dispersed in a water-miscible solvent.

4. The photothermographic material of claim 3, wherein the water-miscible solvent is methyl ethyl ketone.

5. The photothermographic material of claim 1, wherein the light sensitive silver halide occludes at least a transition metal selected from the group consisting of elements in groups 6 to 11 of the periodic table, the transition metal being occluded within the region between ½ of the grain volume and the surface of the grain.

6. The photothermographic material of claim 5, wherein the transition metal is selected from the group consisting of iron, cobalt, ruthenium, rhodium, rhenium, osmium and iridium.

7. The photothermographic material of claim 1, wherein the organic silver salt is a silver salt of a long chain fatty acid having 10 to 30 carbon atoms or a silver salt of a nitrogen containing heterocyclic compound, and the organic silver salt being comprised of grains having an average grain size of 0.05 to 1.5 $\mu$m.

8. The photothermographic material of claim 1, wherein the total amount of the organic silver salt and the light sensitive silver halide is 0.5 to 2.2 g/m$^2$, in terms of silver.

9. The photothermographic material of claim 1, wherein the light sensitive silver halide accounts for 0.1 to 50% by weight of the total amount of the organic silver salt and silver halide, based on silver.

10. The photothermographic material of claim 1, wherein not more than 25% by number of the light sensitive silver halide grains having a grain diameter of 10 to 100 nm is not in contact with developed silver when the photothermographic material is subjected to light exposure of 280 $\mu$J/cm$^2$ and thermal development at 123° C. for 16.5 sec.

11. The photothermographic material of claim 10, wherein the light sensitive silver halide grains have been subjected to chemical sensitization using a chalcogen atom containing organic sensitizer.

12. The photothermographic material of claim 2, wherein the organic silver salt is comprised of grains having an average grain size of 0.05 to 1.5 $\mu$m, the total amount of the organic silver salt and the light sensitive silver halide being 0.5 to 2.2 g/m$^2$, based on silver and the silver halide accounting for 0.1 to 50% by weight of the total amount of the organic silver salt and silver halide, based on silver.

13. The photothermographic material of claim 2, wherein the photothermographic material further comprises a reducing agent, a cross-linking agent and a binder other than the hydrophilic binder.

14. A method of preparing a photothermographic material comprising a Light sensitive layer composition coated on a support to form a light sensitive layer, and wherein the photothermographic material comprises an organic silver salt, light sensitive silver halide grains and 0.5 to 2 g of a hydrophilic binder per mole of the organic silver salt, the method comprising the steps of:

forming the light-sensitive layer composite by forming the organic silver salt in the presence of $7\times10^{15}$ to $3\times10^{17}$ of the light-sensitive silver halide grains per mol of the organic silver salt, said silver halide grains having an average equivalent sphere diameter of 0.03 to 0.07 $\mu$m; and thereafter coating the light sensitive composition onto the support.

15. The method of claim 14, wherein prior to step (b), the light sensitive layer composition is subjected to filtration using a filter exhibiting a semi-absolute filtering precision of 5 to 50 $\mu$m.

16. The method of claim 14, wherein in step (b), a protective layer composition is coated simultaneously with the light sensitive layer composition to form the protective layer on the light sensitive layer.

17. The method of claim 16, wherein the protective layer composition exhibits a viscosity of not less than 0.1 Pa-s and the light sensitive layer composition exhibiting a viscosity of not less than 0.03 Pa·s.

18. The method of claim 14, wherein the light sensitive silver halide accounts for 0.1 to 50% by weight of the total amount of the organic silver salt and silver halide, based on silver.

* * * * *